US011847959B2

(12) United States Patent
Jang et al.

(10) Patent No.: US 11,847,959 B2
(45) Date of Patent: Dec. 19, 2023

(54) DISPLAY DEVICE HAVING SENSING MODE FOR SENSING ELECTRICAL CHARACTERISTICS OF PIXELS

(71) Applicant: Samsung Display Co., LTD., Yongin-si (KR)

(72) Inventors: Dae Gwang Jang, Yongin-si (KR); Soo Yeon Kim, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/751,122

(22) Filed: May 23, 2022

(65) Prior Publication Data

US 2023/0057284 A1 Feb. 23, 2023

(30) Foreign Application Priority Data

Aug. 20, 2021 (KR) ..... 10-2021-0110432

(51) Int. Cl.
*G09G 3/32* (2016.01)

(52) U.S. Cl.
CPC ..... *G09G 3/32* (2013.01); *G09G 2300/043* (2013.01); *G09G 2300/0819* (2013.01);
(Continued)

(58) Field of Classification Search
CPC ..... G09G 3/32–3291; G09G 2300/0421–043; G09G 2300/0809; G09G 2300/0819; G09G 2310/0243; G09G 2310/0248; G09G 2310/0251; G09G 2310/0278; G09G 2310/06; G09G 2310/08; G09G 2320/0209; G09G 2320/0219;
(Continued)

(56) References Cited

U.S. PATENT DOCUMENTS

2007/0115244 A1* 5/2007 Shin ..... G09G 3/3266 345/100
2013/0328848 A1* 12/2013 Chao ..... G09G 3/3233 345/211

(Continued)

FOREIGN PATENT DOCUMENTS

KR 2017049798 A * 5/2017 ..... G09G 3/3233
KR 10-2017673 9/2019
KR 10-2021-0039556 4/2021

OTHER PUBLICATIONS

English translation of KR-2017049798-A (Year: 2017).*

*Primary Examiner* — Nathan Danielsen
(74) *Attorney, Agent, or Firm* — KILE PARK REED & HOUTTEMAN PLLC

(57) ABSTRACT

A display panel includes pixels connected to first and second data lines and a readout line. The data driver supplies data signals to the first and second data lines and supplies an initialization voltage to the readout line. Each of the pixels includes at least one light emitting element and a driving transistor. The driving transistor controls an amount of current based on a difference between a corresponding data signal among the data signals and an initialization voltage. In a sensing mode, the data driver supplies a test voltage to the first data line and a first off voltage to the second data line in a first period and supplies a second off voltage to the second data line in a second period after the first period. The second off voltage is different from the test voltage and the first off voltage.

18 Claims, 18 Drawing Sheets

(52) U.S. Cl.
CPC ..... *G09G 2310/0251* (2013.01); *G09G 2310/0278* (2013.01); *G09G 2320/029* (2013.01); *G09G 2320/045* (2013.01)

(58) Field of Classification Search
CPC ..... G09G 2320/0233; G09G 2320/029; G09G 2320/0295; G09G 2320/043; G09G 2320/045; G09G 2320/0693
See application file for complete search history.

(56) References Cited

U.S. PATENT DOCUMENTS

| | | | | |
|---|---|---|---|---|
| 2014/0022289 | A1* | 1/2014 | Lee | G09G 3/3233 345/76 |
| 2017/0186373 | A1* | 6/2017 | Nishikawa | G09G 3/3233 |
| 2020/0160781 | A1* | 5/2020 | Park | G09G 3/3233 |
| 2021/0104185 | A1 | 4/2021 | Park | |

* cited by examiner

DISPLAY DEVICE HAVING SENSING MODE FOR SENSING ELECTRICAL CHARACTERISTICS OF PIXELS

CROSS-REFERENCE TO RELATED APPLICATION(S)

This application claims priority to and the benefit of Korean Patent Application No. 10-2021-0110432 under 35 U.S.C. § 119, filed in the Korean Intellectual Property Office (KIPO) on Aug. 20, 2021, the entire contents of which are incorporated herein by reference.

BACKGROUND

1. Technical Field

The disclosure relates to a display device.

2. Description of the Related Art

A display device includes pixels, and each of pixels includes a driving transistor that transfers a driving current to a light emitting element and a light emitting element that emits light with luminance corresponding to the driving current.

Electrical characteristics of the pixel, such as a threshold voltage of the driving transistor and a threshold voltage of the light emitting element, may be factors that determine the driving current, and the electrical characteristics of the pixel may vary due to various causes, such as process deviation and aging.

The display device senses the electrical characteristic of the pixel using an external compensation technology and compensates for a change in the electrical characteristic of the pixel.

SUMMARY

It is an object of the disclosure to provide a display device capable of more accurately sensing the electrical characteristics of the pixel.

The object of the disclosure is not limited to the aforesaid, but other objects not described herein will be clearly understood by those skilled in the art from descriptions below.

A display device according to embodiments of the disclosure may include a display panel including scan lines, a first data line, a second data line, a readout line, and pixels electrically connected to the scan lines, the first and second data lines, and the readout line; a scan driver supplying a scan signal to the scan lines; and a data driver supplying data signals to the first and second data lines and supplying an initialization voltage to the readout line. Each of the pixels may include at least one light emitting element and a driving transistor, the driving transistor controlling an amount of current flowing through the driving transistor based on a difference between a corresponding data signal among the data signals and the initialization voltage. In the sensing mode, the data driver may supply a test voltage to the first data line and a first off voltage to the second data line in a first period, and may supply a second off voltage to the second data line in a second period after the first period. The second off voltage may be different from the test voltage and the first off voltage.

In an embodiment, the pixels may include a first pixel electrically connected to the first data line and a second pixel electrically connected to the second data line, and the data driver may sense an electrical characteristic of the first pixel based on a sensing signal output from the readout line in response to the test voltage in the first period.

In an embodiment, the driving transistor of the second pixel receiving the first off voltage or the second off voltage may be substantially turned off.

In an embodiment, the first period and the second period may be included in a sensing period, and the sensing period may be allocated for each scan line.

In an embodiment, the first off voltage may have a voltage level lower than the second off voltage.

In an embodiment, the first off voltage may have a voltage level lower than the initialization voltage.

In an embodiment, in the first period, a gate-source voltage of the driving transistor of the second pixel may be lower than a negative threshold voltage of the driving transistor of the second pixel.

In an embodiment, the second off voltage may have a voltage level equal to or higher than the initialization voltage.

In an embodiment, the readout line may be commonly connected to the first pixel and the second pixel.

In an embodiment, in a third period between the first period and the second period, the data driver may supply the first off voltage to the first data line and the test voltage to the second data line, and the data driver may sense an electrical characteristic of the second pixel based on a sensing signal output from the readout line in response to the test voltage in the third period.

In an embodiment, the first pixel may further include a first switching transistor electrically connected between the first data line and a gate electrode of the driving transistor and including a gate electrode receiving the scan signal, and a second switching transistor electrically connected between the readout line and an electrode of the driving transistor and including a gate electrode receiving the scan signal, wherein the electrode of the driving transistor may be electrically connected to the at least one light emitting element.

In an embodiment, the gate electrode of the first switching transistor may be electrically connected to the gate electrode of the second switching transistor.

In an embodiment, the at least one light emitting element may include a plurality of light emitting diodes electrically connected in series.

In an embodiment, in the first period, the scan driver may sequentially output the scan signal to the scan lines.

A display device according to embodiments of the disclosure may include a display panel including scan lines, a first data line, a second data line, a readout line, and pixels electrically connected to the scan lines, the first and second data lines, and the readout line; a scan driver supplying a scan signal to the scan lines; and a data driver supplying data signals to the first and second data lines. Each of the pixels may include at least one light emitting element and a driving transistor, and the driving transistor may control an amount of current flowing through the driving transistor based on a corresponding data signal among the data signals. In the sensing mode, the data driver may supply a test voltage to the first data line, an off voltage to the second data line, and a first initialization voltage to the readout line in a first period, and may supply a second initialization voltage to the readout line in a second period after the first period. The second initialization voltage may be different from the first initialization voltage.

In an embodiment, the pixels may include a first pixel electrically connected to the first data line and a second pixel electrically connected to the second data line, and the data driver may sense an electrical characteristic of the first pixel based on a sensing signal output from the readout line in response to the test voltage in the first period.

In an embodiment, the first initialization voltage may have a voltage level higher than the second initialization voltage.

In an embodiment, the first initialization voltage may have a voltage level higher than the off voltage.

In an embodiment, the second initialization voltage may have a voltage level equal to or lower than the off voltage.

In an embodiment, the display device may further include a power supply supplying the first initialization voltage and the second initialization voltage to the data driver, wherein the data driver may select and supply the first initialization voltage or the second initialization voltage to the readout line.

Specific details of other embodiments are included in specification and drawings.

The display device according to the embodiments of the disclosure, in sensing the electrical characteristic of the first pixel in a sensing mode (or a sensing period), may provide a first off voltage (i.e., a voltage lower than the initialization voltage) to the second pixel that is not a sensing target in the first period through the second data line. Accordingly, a leakage current from the second pixel can be completely blocked, and only the electrical characteristic of the first pixel can be accurately sensed.

Also, the display device may provide a second off voltage to the second pixel in the second period. Accordingly, deterioration of the reliability of the first transistor of the second pixel due to an application of a first off voltage (or a negative gate-source voltage) for a long time may be prevented.

Effects according to embodiments are not limited by contents exemplified above, and more various effects are included in the specification.

BRIEF DESCRIPTION OF THE DRAWINGS

An additional appreciation according to the embodiments of the disclosure will become more apparent by describing in detail the embodiments thereof with reference to the accompanying drawings.

DETAILED DESCRIPTION OF THE EMBODIMENTS

Figure 1:
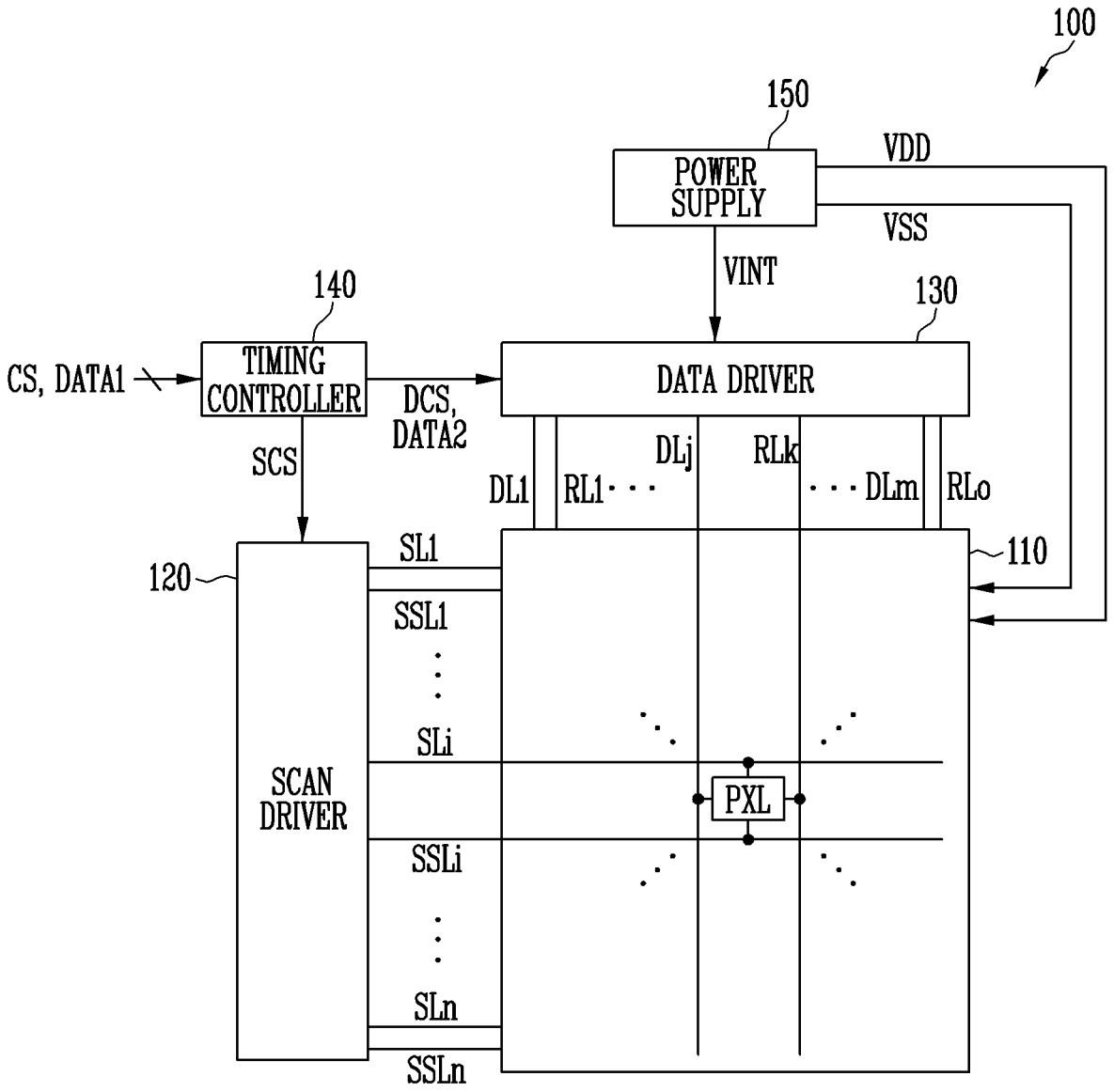
FIG. 1 is a schematic block diagram illustrating a display device according to embodiments of the disclosure.

It will be apparent to those skilled in the art that various modifications and variations can be made in the disclosure without departing from the spirit or scope of the disclosure, and specific embodiments are exemplified in the drawings and explained in the detailed description. The terms of a singular form may include plural forms (or meanings) unless referred to the contrary.

Some embodiments may be described in the accompanying drawings in relation to functional blocks, units and/or modules. Those skilled in the art will understand that such blocks, units, and/or modules are physically implemented by logic circuits, discrete components, microprocessors, hard-wired circuits, memory elements, wiring connections, and other electronic circuits. It may be formed using semiconductor-based manufacturing technology or other manufacturing technology. Blocks, units, and/or modules implemented by a microprocessor or other similar hardware may be programmed and controlled using software to perform various functions discussed in the disclosure, and may be driven by firmware and/or software optionally. In addition, each block, unit, and/or module may be implemented by dedicated hardware, or may be implemented as a combination of a processor (e.g., one or more programmed microprocessors and related circuits) that performs functions different from the dedicated hardware that performs some functions. Further, in some embodiments, blocks, units and/or modules may be physically separated into two or more individual blocks, units and/or modules that interact in a scope of a concept of the disclosure. Further, in some embodiments, blocks, units and/or modules may be physically combined into more complex blocks, units and/or modules in the scope of a concept of the disclosure.

On the other hand, the disclosure is not limited to embodiments disclosed below, and may be implemented in various forms. In addition, each of the embodiments disclosed below may be implemented alone, or may be implemented in combination with at least one other embodiment.

In the drawings, some constituent elements which are not directly related to features of the disclosure may be omitted in order to clearly indicate the disclosure. In addition, some of the elements in the drawing can be shown in somewhat exaggerated sizes, ratios, and the like. For the same or similar constituent elements throughout drawing, the same reference numerals and symbols are to be given as much as possible even if they are displayed on different drawings, and duplicate descriptions will be omitted.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present.

The terms "about" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations, or within ±30%, 20%, 10%, 5% of the stated value.

It will be understood that the terms "contact," "connected to," and "coupled to" may include a physical and/or electrical contact, connection, or coupling.

The phrase "at least one of" is intended to include the meaning of "at least one selected from the group of" for the purpose of its meaning and interpretation. For example, "at least one of A and B" may be understood to mean "A, B, or A and B."

Unless otherwise defined or implied herein, all terms (including technical and scientific terms) used herein have the same meaning as commonly understood by those skilled in the art to which this disclosure pertains. It will be further understood that terms, such as those defined in commonly used dictionaries, should be interpreted as having a meaning that is consistent with their meaning in the context of the relevant art and the disclosure, and should not be interpreted in an ideal or excessively formal sense unless clearly so defined herein.

FIG. 1 is a schematic block diagram illustrating a display device according to embodiments of the disclosure.

Referring to FIG. 1, a display device 100 may include a display unit 110 (or a display panel), a scan driver 120 (or a gate driver), a data driver 130 (or a source driver), a timing controller 140, and a power supply 150. The scan driver 120, the data driver 130, the timing controller 140, and the power supply 150 may form (or constitute) a driving device for driving the display unit 110.

The display unit 110 may display an image. The display unit 110 may include scan lines SL1 to SLn, data lines DL1 to DLm, readout lines RL1 to RLo (or sensing lines), and a pixel PXL (here, each of n and m is a positive integer and o is a positive integer less than or equal to m). The display unit 110 may further include sensing scan lines SSL1 to SSLn.

The pixel PXL may be disposed or disposed in an area (e.g., a pixel area) partitioned by the scan lines SL1 to SLn and the data lines DL1 to DLm.

The pixel PXL may be electrically connected to one of the scan lines SL1 to SLn and one of the data lines DL1 to DLm. The pixel PXL may be electrically connected to one of the sensing scan lines SSL1 to SSLn and one of the readout lines RL1 to RLo.

For example, the pixels PXL disposed in the i-th row and the j-th column may be electrically connected to the i-th scan line SLi, the i-th sensing scan line SSLi, the j-th data line DLj, and the k-th readout line RLk (here, each of i and j is a positive integer and k is a positive integer less than or equal to j). The pixel PXL may be electrically connected between a first power line to which a first power voltage VDD is applied and a second power line to which a second power voltage VSS is applied. The first and second power voltages VDD and VSS may be power voltages or driving voltages necessary for an operation of the pixel PXL, and the first power voltage VDD may have a voltage level higher than a voltage level of the second power voltage VSS. For example, the second power voltage VSS may be 0V, and the first power voltage VDD may be 20V. The first and second power voltages VDD and VSS may be provided to the display unit 110 from the power supply 150.

The pixel PXL may be initialized by using a third power voltage VINT (or initialization voltage) provided through the k-th readout line RLk in response to a sensing scan signal provided through the i-th sensing scan line SSLi, may store or write a data signal (or data voltage) provided through the j-th data line DLj in response to a scan signal provided through the i-th scan line SLi, and may emit light with luminance corresponding to the stored data signal. A voltage level of the third power voltage VINT may be set to be lower than an operating point (or threshold voltage) of the light emitting element in the pixel PXL. For example, the third power voltage VINT may be 2V or 3V. The third power voltage VINT may be provided from the power supply 150 to the display unit 110 through the data driver 130. A detailed configuration of the pixel PXL will be described below with reference to FIG. 2.

The scan driver 120 may generate a scan signal (or scan signals) based on a scan control signal SCS and may sequentially provide the scan signal to the scan lines SL1 to SLn. The scan control signal SCS may include a start signal, clock signals, and the like, and may be provided from the timing controller 140 to the scan driver 120. For example, the scan driver 120 may be implemented as a shift register that generates and outputs a scan signal by sequentially shifting a pulse-shaped start signal using clock signals. Similar to a method of generating the scan signal, the scan driver 120 may generate the sensing scan signal and may sequentially provide the sensing scan signal to the sensing scan lines SSL1 to SSLn.

The scan driver 120 may be formed on the display unit 110 together with the pixel PXL. However, the disclosure is not limited thereto. For example, the scan driver 120 may be mounted on a circuit film and may be electrically connected to the timing controller 140 via at least one circuit film and a printed circuit board.

The data driver 130 may generate data signals (or data voltages) based on image data DATA2 and a data control signal DCS provided from the timing controller 140, and may provide the data signals to the display unit 110 (or pixel PXL) through the data lines DL1 to DLm. The data control signal DCS may be a signal that controls an operation of the data driver 130, and may include a load signal (or data enable signal) indicating output of a valid data signal, a horizontal start signal, a data clock signal, and the like. For example, the data driver 130 may include a shift register generating a sampling signal by shifting a horizontal start signal in synchronization with a data clock signal, a latch latching the image data DATA2 in response to the sampling signal, a digital-to-analog converter (or decoder) that converts the latched image data (e.g., data in digital form) into data signals in analog form, and buffers (or amplifiers) that output data signals to the data lines DL1 to DLm. The data driver 130 may provide the third power voltage VINT (e.g., the third power voltage VINT provided from the power supply 150) to the display unit 110 (or pixel PXL) through the readout lines RL1 to RLo.

In some embodiments, the data driver 130 may provide a test signal (or a test voltage) to the pixel PXL through the data lines DL1 to DLm and may receive a sensing signal from the pixel PXL through the readout lines RL1 to RLo, in a separate sensing mode or sensing period (e.g., in the sensing period allocated to sense electrical characteristics of the pixel PXL, such as a threshold voltage and/or mobility of a driving transistor included in the pixel PXL). The sensing signal may be used to compensate for an electrical characteristic (or a characteristic deviation) of the pixel PXL in the data driver 130 or the timing controller 140. The configuration of the data driver 130 for sensing the electrical characteristics of the pixel PXL will be described below with reference to FIG. 3.

In an embodiment, the sensing period may include a first period (or individual sensing period) and a second period (or reset period), and the data driver 130 may provide a test signal to a target pixel (e.g., a pixel PXL to sense electrical characteristics or a data line electrically connected to the pixel PXL), and may provide a first turn-off voltage (or first off voltage) to the remaining pixel (e.g., a pixel other than a target pixel or a data line electrically connected to the remaining pixel) in the first period, and the data driver 130 may provide a second turn-off voltage (or a second off voltage) to the remaining pixel (and the target pixel) in the second period. The test signal may have a voltage level that turns on the driving transistor included in the pixel PXL, and the first turn-off voltage and the second turn-off voltage may have a voltage level that turns off the driving transistor. The first turn-off voltage may have a voltage level lower than the second turn-off voltage.

As it will be described below with reference to FIGS. 6 and 7, in order to completely turn off the driving transistor even when the threshold voltage of the driving transistor is shifted in a negative direction, the first turn-off voltage used in the first period of the sensing period may have a voltage level that makes a gate-source voltage of the driving transistor less than zero (or negative threshold voltage). In this case, no sensing signal may be actually output from the remaining pixels, and only the sensing signal for the target pixel may be accurately obtained. In case that the first turn-off voltage is continuously (or for a long time) provided to the remaining pixels during the sensing period (or in case that the gate-source voltage of the driving transistor of the pixel PXL has a negative value for a long time), the reliability of the driving transistor of the pixel PXL may be deteriorated (e.g., a defect may occur in a channel of the driving transistor). Therefore, the second turn-off voltage used in the second period (e.g., a reset period) of the sensing period may have a voltage level that makes the gate-source voltage of the driving transistor greater than zero.

The data driver 130 may be mounted on a circuit film and may be electrically connected to the timing controller 140 via at least one printed circuit board and/or a cable.

The timing controller 140 may receive input image data DATA1 and a control signal CS from the external (e.g., a graphics processor), may generate a scan control signal SCS and a data control signal DCS based on the control signal CS, and may convert the input image data DATA1 to generate the image data DATA2. The control signal CS may include a vertical synchronization signal, a horizontal synchronization signal, a reference clock signal, and the like. The vertical synchronization signal may indicate a start of frame data (e.g., data corresponding to a frame period in which a frame image is displayed), and the horizontal synchronization signal may indicate a start of a data row (e.g., a data row among data rows included in the frame data). For example, the timing controller 140 may convert the input image data DATA1 into the image data DATA2 having a format matching a pixel arrangement in the display unit 110.

The power supply 150 may supply the first power voltage VDD and the second power voltage VSS to the display unit 110. The power supply 150 may provide the third power voltage VINT to the data driver 130. The power supply 150 may provide at least one power voltage necessary for driving at least one of the scan driver 120, the data driver 130, and the timing controller 140. The power supply 150 may be implemented as a power management integrated circuit (PMIC).

In embodiments, the power supply 150 (or data driver 130) may change a voltage level of the third power voltage VINT (or initialization voltage VINT) provided to the display unit 110 in the sensing period. For example, the third power voltage VINT may have a first voltage level in the first period of the sensing period and may have a second voltage level in the second period of the sensing period. The first voltage level and the second voltage level of the third power voltage VINT may be set to be lower than an operating point of the light emitting element, and the first voltage level may be higher than the second voltage level. For example, in the first period of the sensing period, the third power voltage VINT may have the first voltage level that makes the gate-source voltage of the driving transistors of the remaining pixels less than zero (or a negative threshold voltage). In the second period of the sensing period, the third power voltage VINT may have the second voltage level that makes the gate-source voltage of the driving transistor greater than zero. The contents that the power supply 150 (or data driver 130) changes the third power voltage VINT will be described below with reference to FIGS. 12 and 13.

As described above, the display device 100 may provide the first turn-off voltage to the remaining pixels (e.g., pixels that are not sensing targets) in the first period (or the individual sensing period) of the sensing period, and may provide the second turn-off voltage to the remaining pixels in the second period (or the reset period) of the sensing period. The display device 100 may vary the third power voltage VINT in the first period and the second period of the sensing period. Therefore, an output of the sensing signal from the remaining pixels in the first period can be completely blocked by the first turn-off voltage (and/or the third power voltage VINT having the first voltage level), and only the electrical characteristics of the target pixel can be sensed accurately. In addition, a deterioration (e.g., a defect of the driving transistor that occurs in case that the first turn-off voltage is applied for a long time) of the reliability of the driving transistor can be prevented due to the second turn-off voltage (and/or the third power voltage VINT having the second voltage level) in the second period.

At least one of the scan driver 120, the data driver 130, the timing controller 140, and the power supply 150 may be formed in the display unit 110 or may be implemented as an integrated circuit to be electrically connected to the display unit 110 in a form of a tape carrier package. At least two of the scan driver 120, the data driver 130, the timing controller 140, and the power supply 150 may be implemented as an integrated circuit. For example, the data driver 130 and the timing controller 140 may be implemented as an integrated circuit.

Figure 2:
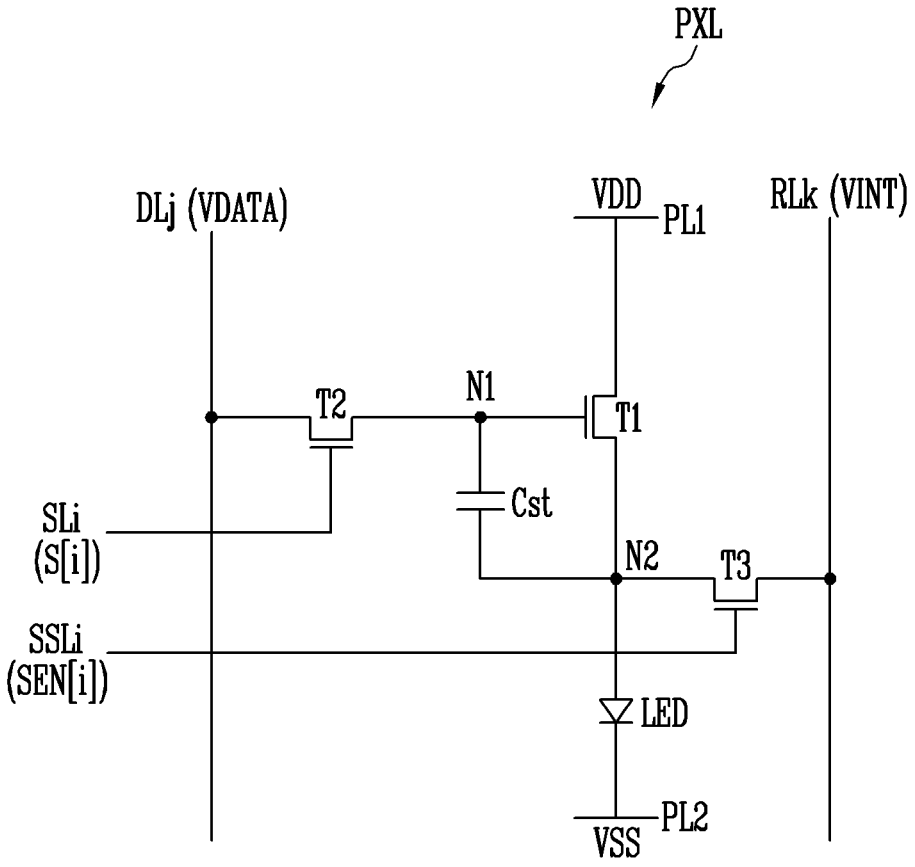
FIG. 2 is a schematic diagram of an equivalent circuit of an embodiment of a pixel included in the display device of FIG. 1.

FIG. 2 is a schematic diagram of an equivalent circuit of an embodiment of a pixel included in the display device of FIG. 1. FIG. 2 illustrates a pixel PXL disposed in the i-th row and the j-th column as an example.

Referring to FIG. 2, the pixel PXL may be electrically connected to the i-th scan line SLi, the j-th data line DLj, the i-th sensing scan line SSLi, and the k-th readout line RLk.

The pixel PXL may include a light emitting element LED, a first transistor T1 (or a driving transistor), a second transistor T2 (or a first switching transistor), a third transistor T3 (or a sensing transistor, a second switching transistor, an initialization transistor), and a storage capacitor Cst. Each of the first transistor T1, the second transistor T2, and the third transistor T3 may be a thin-film transistor including an oxide semiconductor, but the disclosure is not limited thereto, and for example, at least one of the first transistor T1, the second transistor T2, and the third transistor T3 may include a polysilicon semiconductor or may be implemented as an N-type semiconductor or a P-type semiconductor.

A first electrode (or an anode electrode) of the light emitting element LED may be electrically connected (or connected) to a second node N2 (or a second electrode of the first transistor T1). The first electrode of the light emitting element LED may be electrically connected to a first power line PL1 via the first transistor T1. A first power voltage VDD may be applied to the first power line PL1. A second electrode (or a cathode electrode) of the light emitting element LED may be electrically connected to the second power line PL2. A second power voltage VSS may be applied to the second power line PL2. The light emitting element LED may generate light with predetermined luminance in response to the amount of current (or a driving current) supplied from the first transistor T1. The light emitting element LED may be composed of an organic light emitting diode or an inorganic light emitting diode such as a micro light emitting diode or a quantum dot light emitting diode. In addition, the light emitting element may be a light emitting diode composed of an organic material and an inorganic material.

A first electrode (e.g., a drain electrode) of the first transistor T1 may be electrically connected to the first power line PL1, and a second electrode (e.g., a source electrode) of the first transistor T1 may be electrically connected to the second node N2 (or the anode electrode of the light emitting element LED). A gate electrode of the first transistor T1 may be electrically connected to the first node N1. The first transistor T1 may control an amount of current flowing through the light emitting element LED in response to a voltage (or a gate-source voltage applied between the second electrode and the gate electrode of the first transistor T1) of the first node N1.

A first electrode of the second transistor T2 may be electrically connected to the j-th data line DLj, and a second electrode thereof may be electrically connected to the first node N1. A gate electrode of the second transistor T2 may be electrically connected to the i-th scan line SLi. In case that an i-th scan signal S[i] is supplied to the i-th scan line SLi, the second transistor T2 may be turned on to transfer a data signal (or a data voltage) VDATA from the j-th data line DLj to the first node N1.

The storage capacitor Cst may be formed or electrically connected between the first node N1 and the first electrode of the light emitting element LED. The storage capacitor Cst may store the voltage of the first node N1, or the storage capacitor Cst may be charged with a charge corresponding to the voltage of the first node N1.

A first electrode of the third transistor T3 may be electrically connected to the second node N2 (or the second electrode of the first transistor T1), and a second electrode of the third transistor T3 may be electrically connected to the k-th readout line RLk. A gate electrode of the third transistor T3 may be electrically connected to the i-th sensing scan line SSLi. The third transistor T3 may electrically connect the second node N2 and the k-th readout line RLk in response to a sensing scan signal SEN[i]. In this case, the third power voltage VINT applied to the k-th readout line RLk may be applied to the second node N2. The voltage of the second node N2 or the first electrode of the light emitting element LED may be initialized by the third power voltage VINT.

In case that the second transistor T2 and the third transistor T3 are simultaneously turned on in response to the i-th scan signal S[i] and the sensing scan signal SEN[i], a voltage difference between the data signal VDATA and the third power voltage VINT may be stored in the storage capacitor Cst, and the first transistor T1 may control the amount of current flowing through the light emitting element LED in response to the voltage difference stored in the storage capacitor Cst.

In contrast, in case that the third transistor T3 maintains the second node N2 and the k-th readout line RLk in an electrically connected state in response to the sensing scan signal SEN[i], a sensing signal (or an amount of current) corresponding to the voltage difference (e.g., the voltage difference between the data signal VDATA and the third power voltage VINT) may be output from the pixel PXL through the k-th readout line RLk. For example, in case that the first transistor T1 is turned on by a test signal (e.g., a test signal or a test voltage applied as the data signal VDATA) in the sensing period, a current flowing through the first transistor T1 in response to the test signal may be output as a sensing signal through the k-th readout line RLk.

In an embodiment, the circuit structure of the pixel PXL is not limited to that illustrated in FIG. 2.

Figure 3:
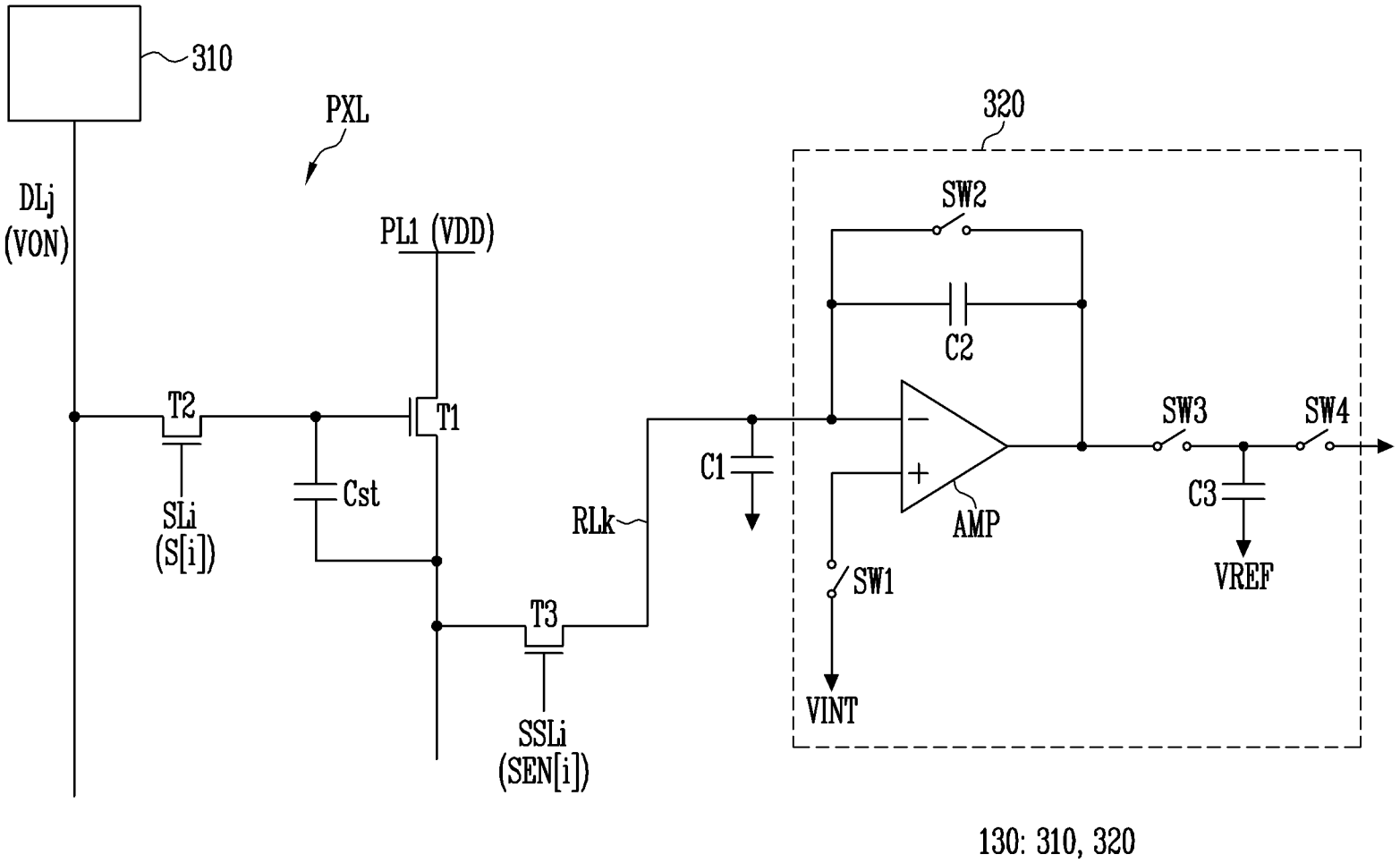
FIG. 3 is a schematic diagram of an equivalent circuit of illustrating an embodiment of a data driver of FIG. 1.

FIG. 3 is a schematic diagram of an equivalent circuit of an embodiment of a data driver of FIG. 1. For convenience of description, FIG. 3 further illustrates a portion of the pixel PXL of FIG. 2.

Referring to FIGS. 1 to 3, the data driver 130 may include a data signal generating circuit 310 and a sensing circuit 320.

The data signal generating circuit 310 may provide a data signal to the j-th data line DLj. The data signal generating circuit 310 may provide a test signal to the j-th data line DLj in the sensing period. For example, the data signal generating circuit 310 may provide a turn-on voltage VON (or an on voltage, a test voltage) to the j-th data line DLj in the sensing period. The turn-on voltage VON may turn on the first transistor T1. As described with reference to FIG. 1, the data signal generating circuit 310 may include a shift register, a latch, a digital-to-analog converter, and a buffer.

The sensing circuit 320 may provide the third power voltage VINT to the pixel PXL through the k-th readout line RLk. The sensing circuit 320 may receive a sensing signal (e.g., a current) corresponding to the turn-on voltage VON from the pixel PXL through the k-th readout line RLk in the sensing period, may integrate the sensing signal, and may sample the integrated sensing signal. The sampled signal may include information about an electrical characteristic (e.g., a threshold voltage of the first transistor T1) of the pixel PXL.

The sensing circuit 320 may include an amplifier AMP, a second capacitor C2, a third capacitor C3, and first, second, third, and fourth switches SW1, SW2, SW3, and SW4 (or switching elements).

A first input terminal (or an inverting terminal (−)) of the amplifier AMP may be electrically connected to the k-th readout line RLk, and a second input terminal (or a non-inverting terminal (+)) of the amplifier AMP may be electrically connected to the first switch SW1. The first capacitor C1 may be electrically connected to the k-th readout line RLk.

The first switch SW1 may be electrically connected between the second input terminal of the amplifier AMP and a terminal to which the third power voltage VINT is applied. The third power voltage VINT may be provided from the power supply 150. In case that the first switch SW1 is turned on, the third power voltage VINT may be applied to the second input terminal and the first input terminal of the amplifier AMP. In case that the third transistor T3 of the pixel PXL is turned on, the third power voltage VINT may be applied to the pixel PXL through the k-th readout line RLk.

The second capacitor C2 may be electrically connected between the first input terminal and an output terminal of the amplifier AMP. The second switch SW2 may be electrically connected in parallel to the second capacitor C2. In case that the second switch SW2 is turned on, the first input terminal and the output terminal of the amplifier AMP may be electrically connected to each other, and the voltage of the output terminal of the amplifier AMP may be initialized by the third power voltage VINT. In case that the second switch SW2 is turned off, the sensing signal (or the amount of current) output from the pixel PXL through the k-th readout line RLk may be integrated by the second capacitor C2, and the voltage of the output terminal of the amplifier AMP may correspond to the integrated sensing signal. For example, in the first period (or the individual sensing period) of the sensing period, the second switch SW2 may be turned off, and the sensing signal may be integrated.

The third switch SW3 may be electrically connected between the output terminal of the amplifier AMP and the third capacitor C3. The third capacitor C3 may be electrically connected between a node to which the third switch SW3 and the fourth switch SW4 are electrically connected and a node to which a reference voltage VREF is applied. In case that the third switch SW3 is turned on, the voltage of the output terminal of the amplifier AMP, for example, the integrated sensing signal may be stored in the third capacitor C3. For example, the integrated sensing signal may be sampled. In case that the fourth switch SW4 is turned on, the sampled signal may be output to the external of the sensing circuit 320. The sampled signal may be converted into digital sensing data through an analog-to-digital converter, and the digital sensing data may be output to the external.

Figure 4:
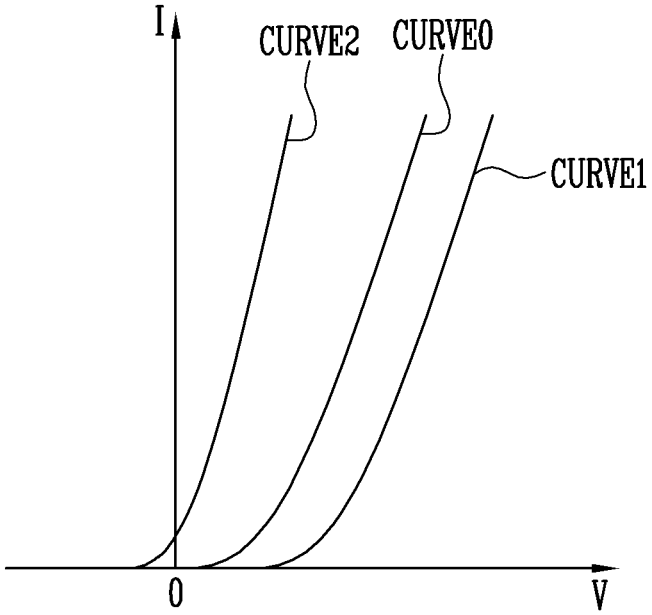
FIG. 4 is a graph illustrating a voltage-current characteristic of a first transistor included in the pixel of FIG. 2.

FIG. 4 is a schematic graph illustrating a voltage-current characteristic of a first transistor included in the pixel of FIG. 2.

Referring to FIGS. 2 and 4, a reference curve CURVE0, a first curve CURVE1, and a second curve CURVE2 may represent a current flowing through the transistor T1 according to the gate-source voltage of the first transistor T1 (or the driving transistor).

The voltage-current characteristic of the first transistor T1 may be shifted from the reference curve CURVE0 to the first curve CURVE1 or the second curve CRUVE2 according to a usage condition of the first transistor T1. For example, in case that the threshold voltage of the first transistor T1 is shifted in a positive direction, the first transistor T1 may have a voltage-current characteristic according to the first curve CURVE1. For another example, in case that the threshold voltage of the first transistor T1 is shifted in a negative direction, the first transistor T1 may have a voltage-current characteristic according to the second curve CURVE2.

For the same gate-source voltage, the current flowing through the first transistor T1 according to the reference curve CURVE0, the first curve CURVE1, and the second curve CURVE2 may be different, and accordingly, the pixel PXL (refer to FIG. 2) may emit light with different luminance. Accordingly, as described with reference to FIG. 3, the voltage-current characteristic (or the threshold voltage, a change thereof) of the first transistor T1 may be sensed so that the pixel PXL may emit light with desired luminance.

On the other hand, in case that the first transistor T1 has the voltage-current characteristics according to the reference curve CURVE0 and the first curve CURVE1, no current may not flow in the first transistor T1 in response to a gate-source voltage of about 0V. For example, the first transistor T1 may be turned off.

However, in case that the first transistor T1 has a voltage-current characteristic according to the second curve CURVE2 (e.g., in case that the first transistor T1 has a negative threshold voltage or the threshold voltage is shifted in a negative direction), a current may flow through the first transistor T1 in response to a gate-source voltage of about 0V. For example, the first transistor T1 may not be completely turned off, and a leakage current may be generated from the pixel PXL including the first transistor T1. The leakage current may affect the sensing signal of other pixels, and the electrical characteristic of the other pixels (e.g., the voltage-current characteristic of the first transistor T1 of the other pixel) may not be accurately sensed.

Accordingly, in order to turn-off the first transistor T1 completely even in case that the threshold voltage of the first transistor T1 is shifted in the negative direction, the display device 100 (refer to FIG. 1) according to embodiments may use the first turn-off voltage having a voltage level that makes the gate-source voltage of the first transistor T1 less than zero (or a negative threshold voltage). In order to prevent the reliability of the first transistor T1 from being deteriorated due to the long-term application of the first turn-off voltage, the display device 100 may reset the first transistor T1 by using the second turn-off voltage having a voltage level that makes the gate-source voltage of the first transistor T1 greater than zero.

A configuration of the display unit 110 (refer to FIG. 1) capable of affecting a sensing signal of a pixel having a different leakage current and a method of driving the display unit 110 will be described hereinafter.

FIGS. 5A, 5B, 5C, and 5D are schematic diagrams of equivalent circuits of embodiments of a display unit in the display device of FIG. 1. FIGS. 5A, 5B, 5C, and 5D illustrate first, second, and third pixels PXL1, PXL2, and PXL3 disposed in the first row and first to third columns in the display unit 110 as examples.

First, referring to FIGS. 1, 2, and 5A to 5D, the first, second, and third pixels PXL1, PXL2, and PXL3 may be substantially the same as or similar to each other. Each of the first, second, and third pixels PXL1, PXL2, and PXL3 may be substantially the same as or similar to the pixel PXL of FIG. 2. Accordingly, the first pixel PXL1 will be described as a representative of the first, second, and third pixels PXL1, PXL2, and PXL3, but repetitive descriptions thereof will be omitted.

Figure 5A:
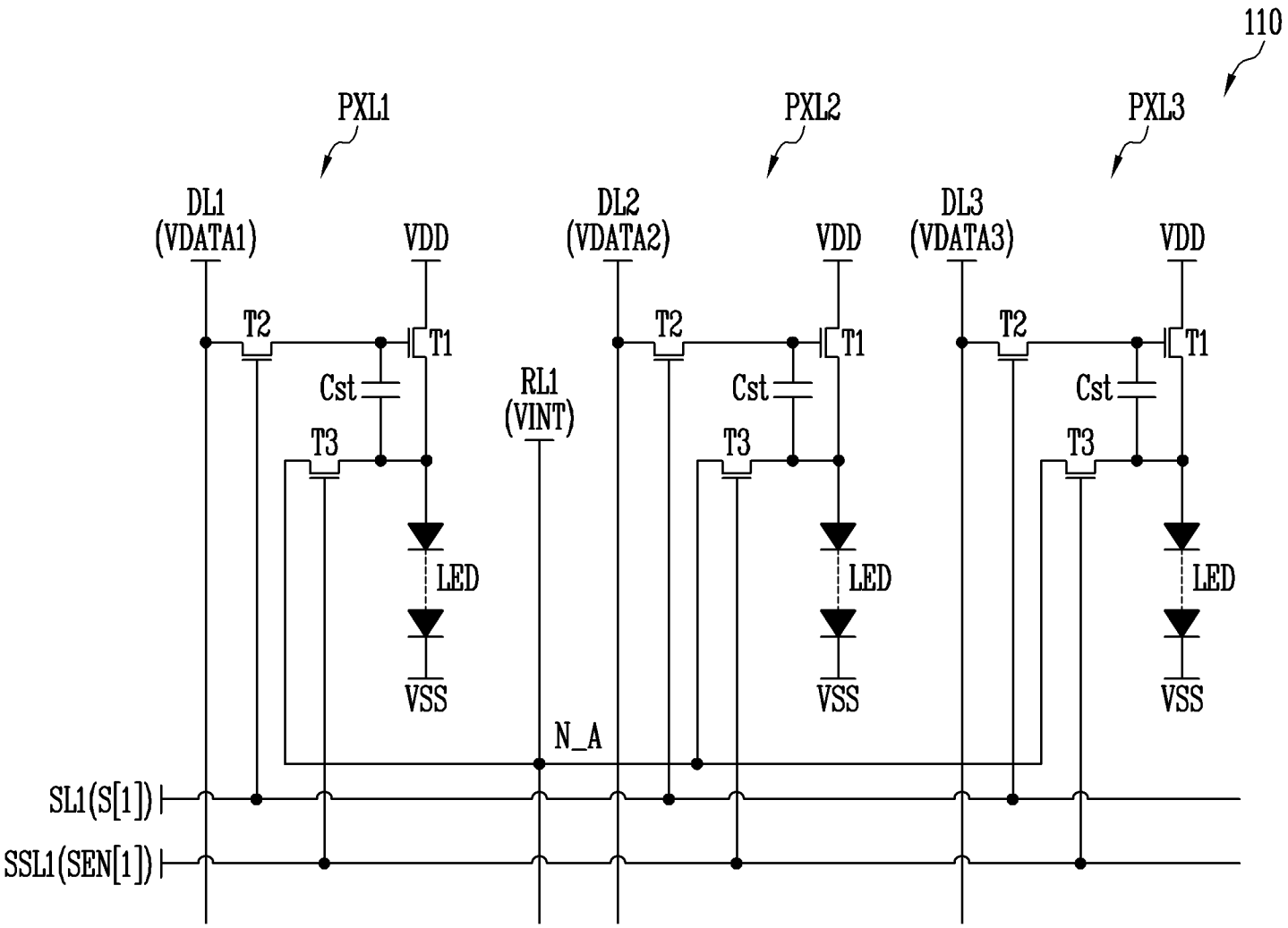
FIGS. 5A, 5B, 5C, and 5D are schematic diagrams of equivalent circuits of embodiments of a display unit in the display device of FIG. 1.
Figure 5B:
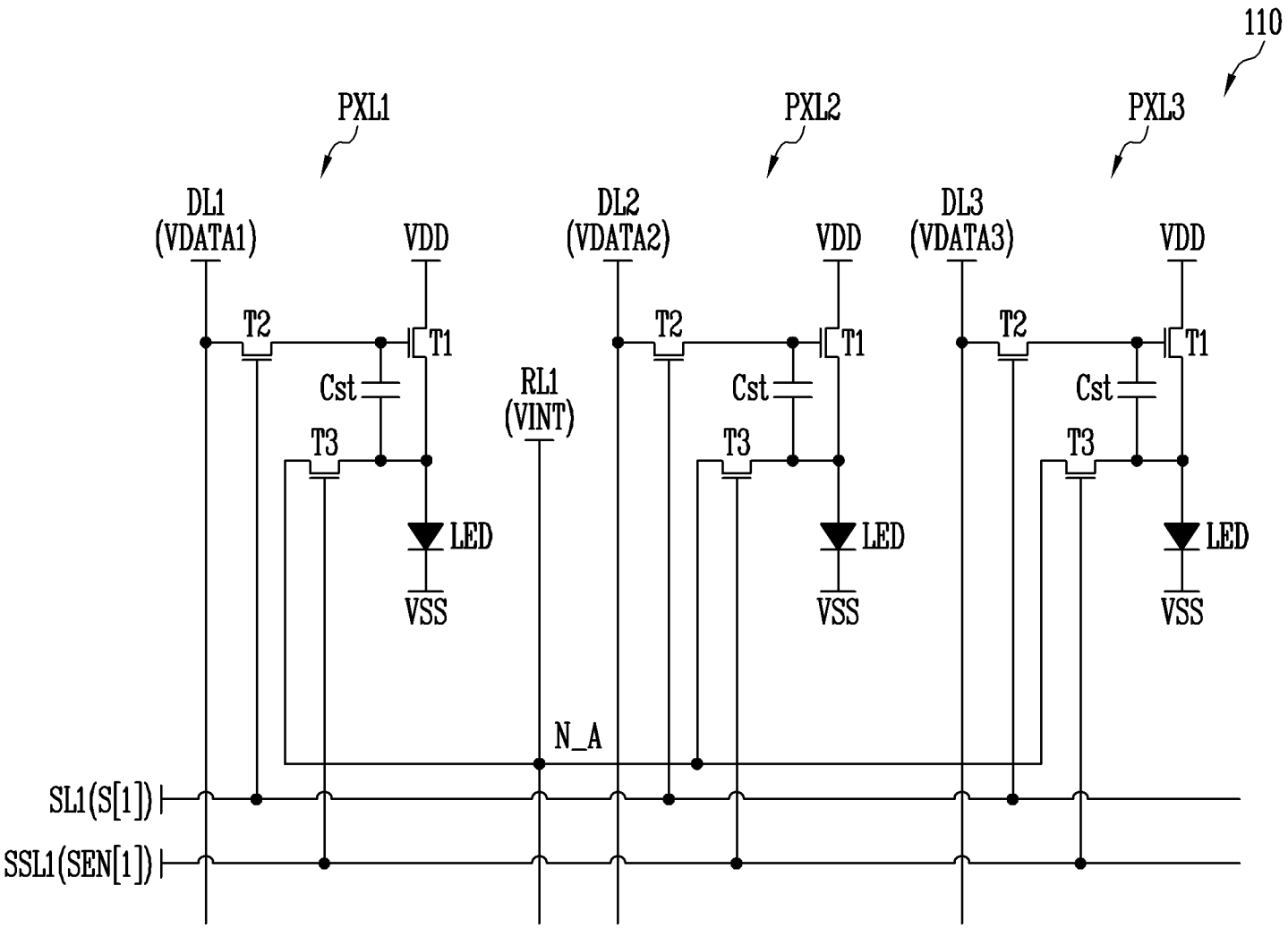
Figure 5C:
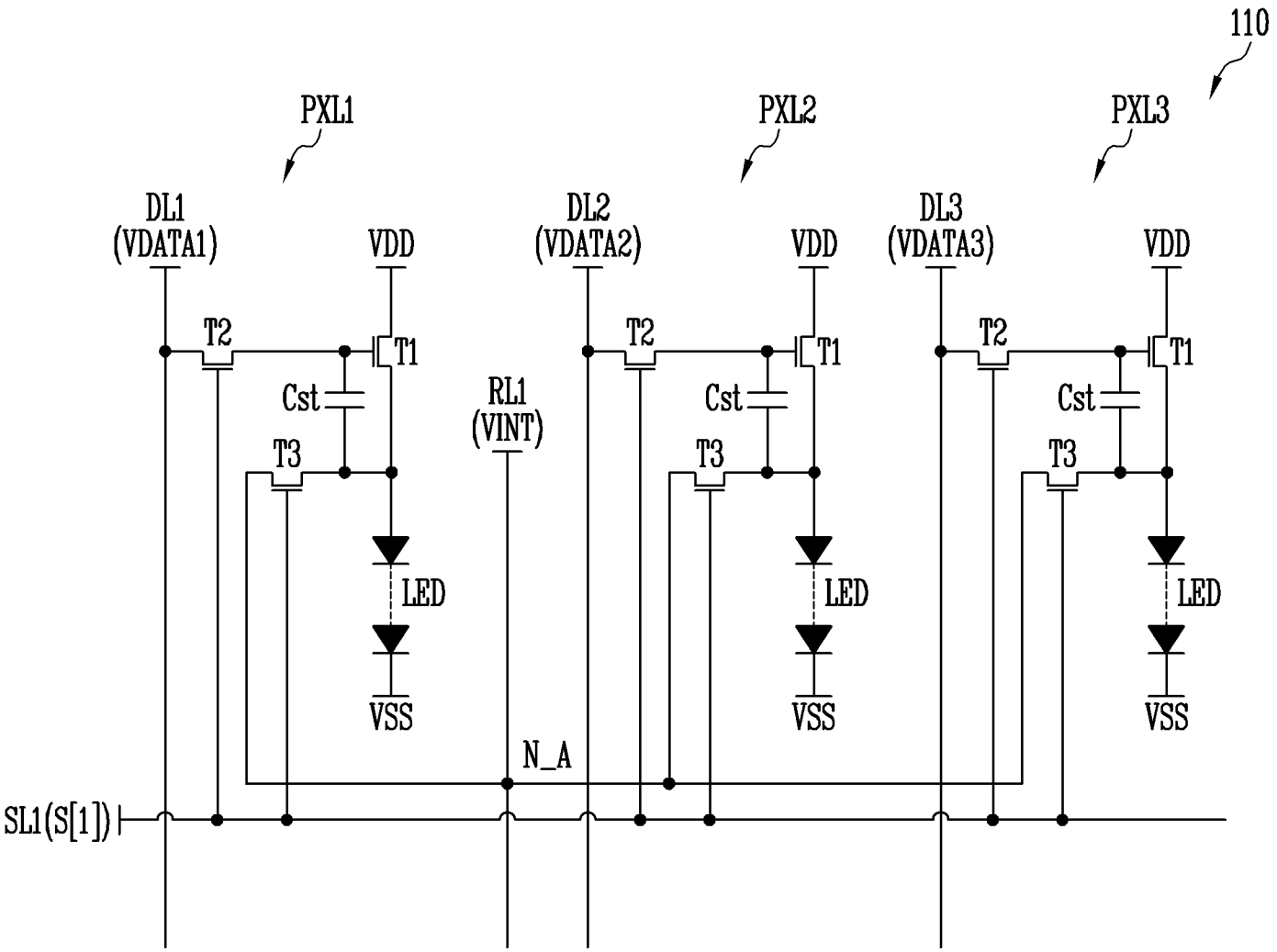
Figure 5D:
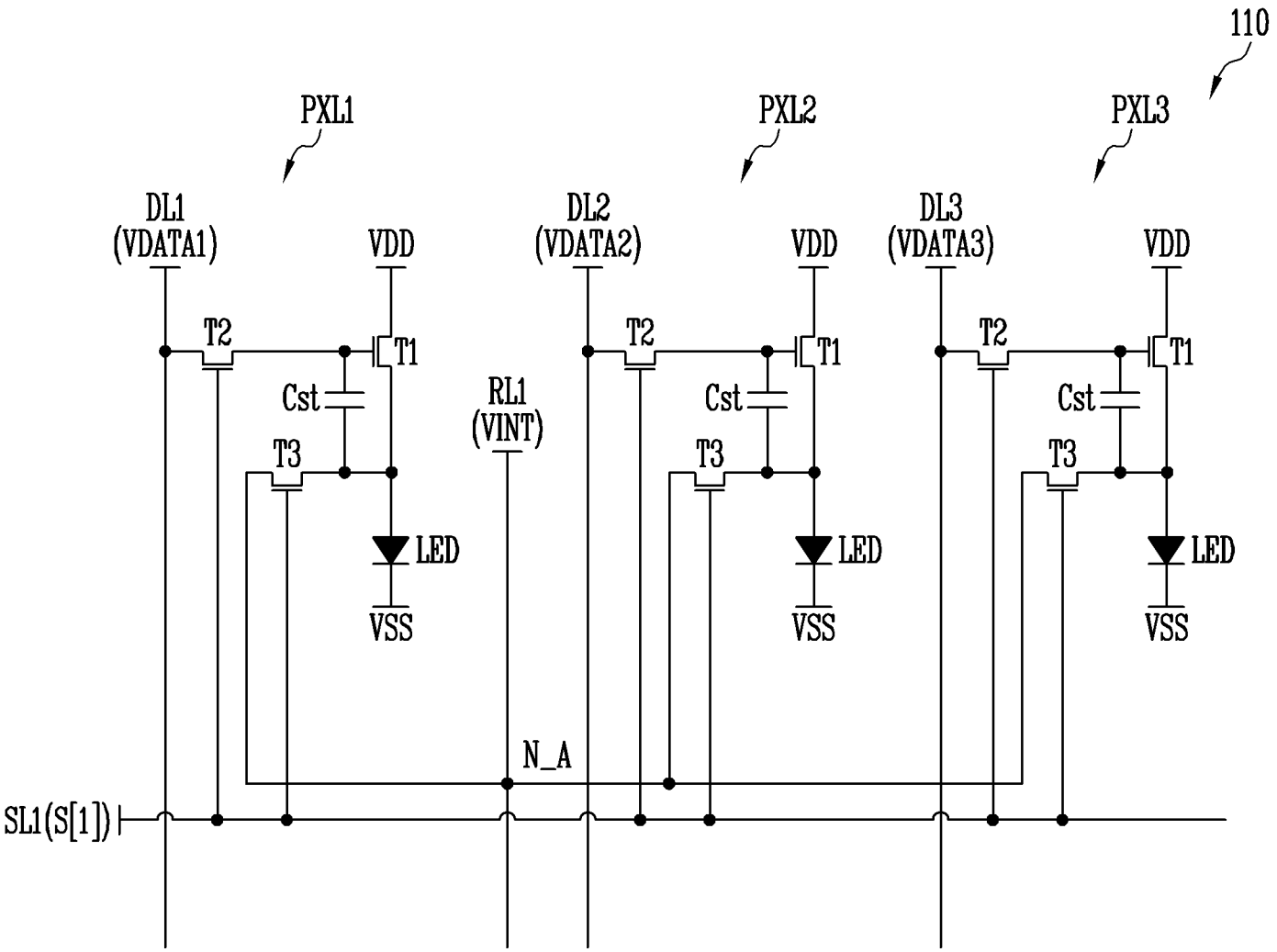

As shown in FIG. 5A, the first pixel PXL1 may include a light emitting element LED, and the light emitting element LED may include light emitting diodes (or light emitting elements) electrically connected in series. For a same current provided from the first transistor T1, the luminance of the first pixel PXL1 including the light emitting diodes may increase. Power efficiency of the first pixel PXL1 may be improved compared to a pixel including light emitting diodes electrically connected to each other in parallel. However, a structure of the light emitting element LED is not limited thereto. For example, as shown in FIGS. 5B and 5D, the light emitting element LED may include only one light emitting diode. For another example, the light emitting element LED may include light emitting diodes electrically connected to each other in parallel.

In an embodiment, the display unit 110 may include only one of the first scan line SL1 and the first sensing scan line SSL1. For example, as shown in FIGS. 5C and 5D, the display unit 110 may include only the first scan line SL1 of the first scan line SL1 and the first sensing scan line SSL1. For example, the gate electrode of the third transistor T3 of each of the first, second, and third pixels PXL1, PXL2, and PXL3 may be electrically connected to the first scan line SL1. The number of lines in the display unit 110 may decrease by the number of sensing scan lines SSL1 to SSLn (refer to FIG. 1).

In embodiments, the first, second, and third pixels PXL1, PXL2, and PXL3 may share the first readout line RL1.

The third transistor T3 of the first pixel PXL1 may be electrically connected to the first readout line RL1. The third transistor T3 of the second pixel PXL2 and the third transistor T3 of the third pixel PXL3 may also be electrically connected to the first readout line RL1. The third transistor T3 of the first, second, and third pixels PXL1, PXL2, and PXL3 may be commonly electrically connected to the first readout line RL1 through a common node N_A. In this case, the number of readout lines RL1 to RLo (refer to FIG. 1) included in the display unit 110 may be reduced. For example, in case that the first, second, and third pixels PXL1, PXL2, and PXL3 share the first readout line RL1, the number of the readout lines RL1 to RLo (refer to FIG. 1) may be reduced to ⅓ of the data lines DL1 to DLm (e.g., o is m/3). In FIGS. 5A to 5D, the first, second, and third pixels PXL1, PXL2, and PXL3, that is, three pixels are illustrated as sharing the first readout line RL1, but the disclosure is not limited thereto. For example, two or four or more pixels may share one readout line.

Since the first, second, and third pixels PXL1, PXL2, and PXL3 share the first readout line RL1, the first scan line SL1, and the first sensing scan line SSL1, the first, second, and third pixels PXL1, PXL2, and PXL3 may be mutually affected.

For example, in response to the first scan signal S[1] (e.g., the first scan signal S[1] applied to the first scan line SL1), the second transistor T2 of each of the pixels PXL1, PXL2, and PXL3 may be turned on, and first, second, and third data signals VDATA1, VDATA2, and VDATA3 may be provided to the first, second, and third pixels PXL1, PXL2, and PXL3 (or the gate electrode of the first transistor T1), and in response to the first sensing scan signal SEN[1] (e.g., the first sensing scan signal SEN[1] applied to the first sensing scan line SSL1), the third transistor T3 of each of the first, second, and third pixels PXL1, PXL2, and PXL3 may be turned on. In case that a leakage current occurs in at least one of the first, second, and third pixels PXL1, PXL2, and PXL3 according to the first, second, and third data signals VDATA1, VDATA2, and VDATA3, the leakage current may be output through the first readout line RL1. FIG. 6 may be referred to describe a method of driving the display device 100 to prevent such leakage current.

Figure 6:
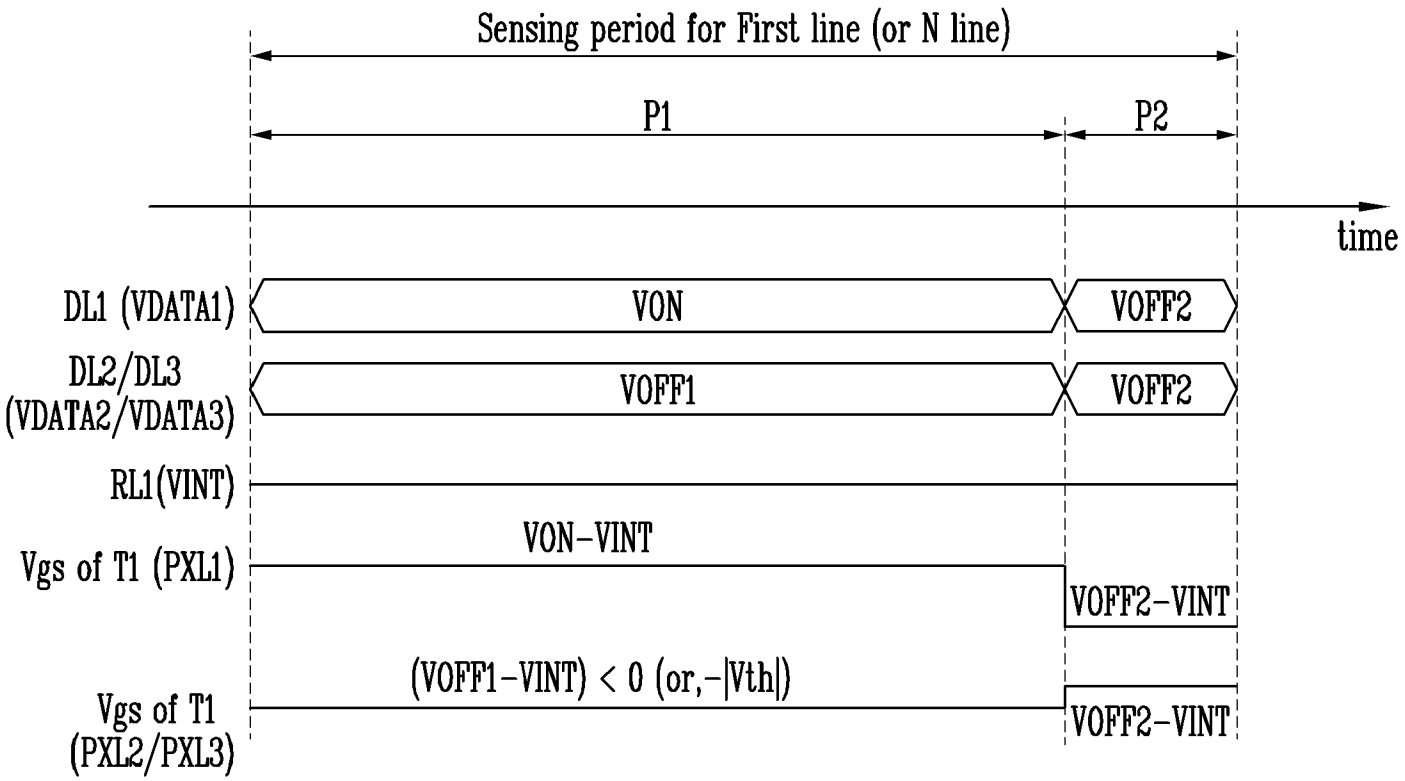
FIG. 6 is a schematic timing diagram illustrating an embodiment of signals measured by the display unit of FIGS. 5A to 5D.
Figure 7:
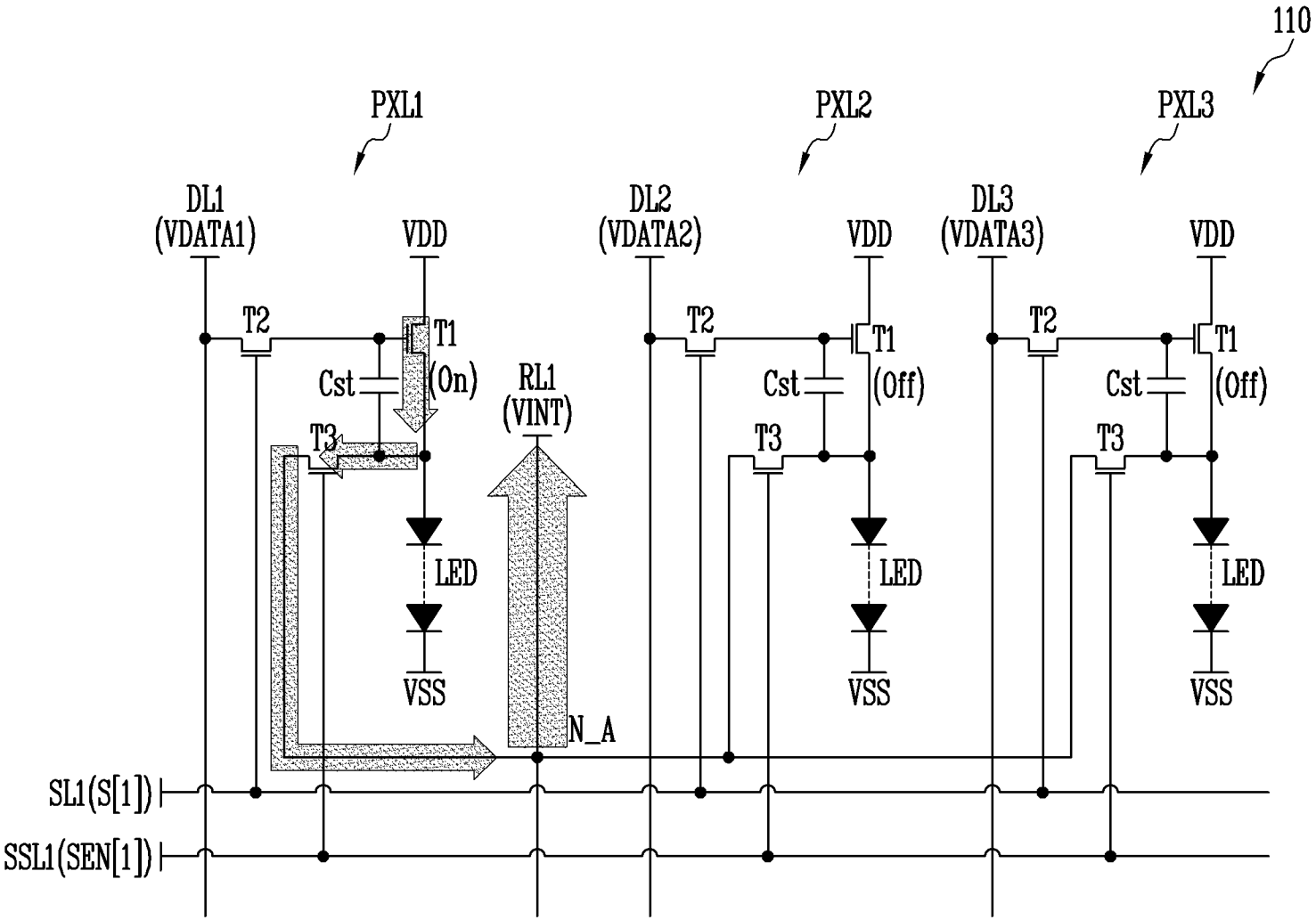
FIG. 7 is a schematic diagram of an equivalent circuit of the display unit of FIG. 5A illustrating an operation of the display unit according to signals of FIG. 6.

FIG. 6 is a schematic timing diagram illustrating an embodiment of signals measured by the display unit of FIGS. 5A to 5D. FIG. 6 illustrates a method of sensing the electrical characteristics of the first pixel PXL1 included in the display unit 110 of FIGS. 5A to 5D. FIG. 7 is a schematic diagram of an equivalent circuit of the display unit of FIG. 5A illustrating an operation of the display unit according to signals of FIG. 6.

Referring to FIGS. 5A to 5D, 6, and 7, the sensing period (e.g., the sensing period for the first line or the first pixel row) may include a first period P1 (or an individual sensing period) and a second period P2 (or a reset period). The sensing period for the N-th line may also include the first period P1 and the second period P2 (here, N is an integer greater than 1). The sensing period may be allocated per line (or per scan line or per pixel row).

In at least portions of the first period P1 and the second period P2, the first scan signal S[1] and the first sensing scan signal SEN[1] may have turn-on voltage levels (e.g., a logic high level), and the second and third transistors T2 and T3 of each of the first, second, and third pixels PXL1, PXL2, and PXL3 may be turned on. In the first period P1 and the second period P2, the third power voltage VINT may be applied to the first readout line RL1, and the third power voltage VINT may be applied to the second electrode (or the source electrode, the second node N2 (refer to FIG. 2)) of the first transistor T1 of each of the first, second, and third pixels PXL1, PXL2, and PXL3 by the third transistor T3 turned on.

The first data signal VDATA1 (or the test signal) applied to the first data line DL1 in the first period P1 may have a turn-on voltage VON (or a test voltage, a turn-on voltage level). The turn-on voltage VON may be applied to the gate electrode of the first transistor T1 of the first pixel PXL1 by the turned-on second transistor T2.

In this case, in the first period P1, a gate-source voltage Vgs of the first transistor T1 of the first pixel PXL1 may be equal to the difference between the turn-on voltage VON and the third power voltage VINT (e.g., Vgs is VON-VINT). As shown in FIG. 7, a sensing signal corresponding to the gate-source voltage Vgs of the first transistor T1 may be output from the first pixel PXL1 through the first readout line RL1.

Referring back to FIG. 6, the second and third data signals VDATA2 and VDATA3 applied to the second and third data lines DL2 and DL3 (or the remaining data lines) in the first period P1 may have a first turn-off voltage VOFF1 (or a first turn-off voltage level). The first turn-off voltage VOFF1 may be applied to the gate electrode of the first transistor T1 of the second and third pixels PXL2 and PXL3 by the turned-on second transistor T2.

In this case, in the first period P1, the gate-source voltage Vgs of the first transistor T1 of each of the second and third pixels PXL2 and PXL3 may be equal to the difference between the first turn-off voltage VOFF1 and the third power voltage VINT (e.g., Vgs is VOFF1−VINT).

In embodiments, the first turn-off voltage VOFF1 may have a voltage level that makes the gate-source voltage Vgs less than zero or a negative threshold voltage −|Vth| (or a negative value with a magnitude of the threshold voltage Vth) of the first transistor T1. In other words, the difference between the first turn-off voltage VOFF1 and the third power voltage VINT may be less than 0 or a negative threshold voltage −|Vth| (e.g., VOFF1−VINT<0, or VOFF1−VINT<−|Vth|). For example, the first turn-off voltage VOFF1 may be lower than the third power voltage VINT or lower than the third power voltage VINT by the level of the threshold voltage Vth. For example, in case that the third power voltage VINT is about 2V and a maximum value of the threshold voltage Vth is about 1V, the first turn-off voltage VOFF1 may be about 1V.

In this case, as described with reference to FIG. 4, even if the threshold voltage Vth of at least one of the first transistors T1 of the second and third pixels PXL2 and PXL3 has a negative value, the first transistor T1 may be completely turned off by the first turn-off voltage VOFF1. As shown in FIG. 7, a leakage current may not be generated from the second and third pixels PXL2 and PXL3 to the first readout line RL1. Accordingly, only the electrical characteristics of the first pixel PXL1 may be accurately sensed in the first period P1.

Referring back to FIG. 6, in the second period P2, the second and third data signals VDATA2 and VDATA3 applied to the second and third data lines DL2 and DL3 may have a second turn-off voltage VOFF2 (or a second turn-off voltage level). The second turn-off voltage VOFF2 may be applied to the gate electrode of the first transistor T1 of each of the second and third pixels PXL2 and PXL3 by the turned-on second transistor T2.

In this case, in the second period P2, the gate-source voltage Vgs of the first transistor T1 of each of the second and third pixels PXL2 and PXL3 may be equal to the difference between the second turn-off voltage VOFF2 and the third power voltage VINT (e.g., Vgs is VOFF2−VINT).

In embodiments, the second turn-off voltage VOFF2 may have a voltage level that makes the gate-source voltage Vgs greater than or equal to zero. In other words, the difference between the second turn-off voltage VOFF2 and the third power voltage VINT may be greater than or equal to zero (e.g., VOFF2−VINT>0), and the second turn-off voltage VOFF2 may be greater than or equal to the third power voltage VINT. For example, the second turn-off voltage VOFF2 may be about 2V. The difference between the second turn-off voltage VOFF2 and the third power voltage VINT may be less than an absolute value |Vth| of the threshold voltage of the first transistor T1, but the disclosure is not limited thereto.

In this case, since the first transistor T1 of each of the second and third pixels PXL2 and PXL3 is reset (or initialized) by the second turn-off voltage VOFF2 in the second period P2, the first turn-off voltage VOFF1 can be prevented from being applied or maintained for a long time, and the deterioration of the reliability of the first transistor T1 can be prevented due to an application of the first turn-off voltage VOFF1 for a long time.

In an embodiment, the first data signal VDATA1 applied to the first data line DL1 in the second period P2 may also have the second turn-off voltage VOFF2. The second turn-off voltage VOFF2 may be applied to the gate electrode of the first transistor T1 of the first pixel PXL1 by the turned-on second transistor T2, and the first transistor T1 of the first pixel PXL1 may also be reset by the second turn-off voltage VOFF2.

As described above, in sensing the electrical characteristics of the first pixel PXL1 in the sensing period (or the sensing mode), the display device 100 (refer to FIG. 1) may provide the first turn-off voltage VOFF1 to the second and third pixels PXL2 and PXL3 (e.g., the remaining pixels sharing the first readout line RL1 with the first pixel PXL1) in the first period P1. Accordingly, the leakage current from the second and third pixels PXL2 and PXL3 can be completely blocked, and only the electrical characteristic of the first pixel PXL1 may be accurately sensed. The display device 100 may provide the second turn-off voltage VOFF2 to the second and third pixels PXL2 and PXL3 in the second period P2. Accordingly, the deterioration of the reliability of the first transistor T1 of each of the second and third pixels PXL2 and PXL3 due to the application of the first turn-off voltage VOFF1 for a long time may be prevented.

It has been described that only the electrical characteristic of the first pixel PXL1 are sensed with reference to FIG. 6, but the disclosure is not limited thereto. For example, by providing the turn-on voltage VON to the second pixel PXL2 and the first turn-off voltage VOFF1 to the first and third pixels PXL1 and PXL3 in the first period P1, the electrical characteristic of the second pixel PXL2 may be sensed. For example, by providing the turn-on voltage VON to the third pixel PXL3 and the first turn-off voltage VOFF1 to the first and second pixels PXL1 and PXL2 in the first period P1, the electrical characteristic of the third pixel PXL3 may be sensed. The electrical characteristic of the first, second, and third pixels PXL1, PXL2, and PXL3 may be sequentially sensed.

Figure 8:
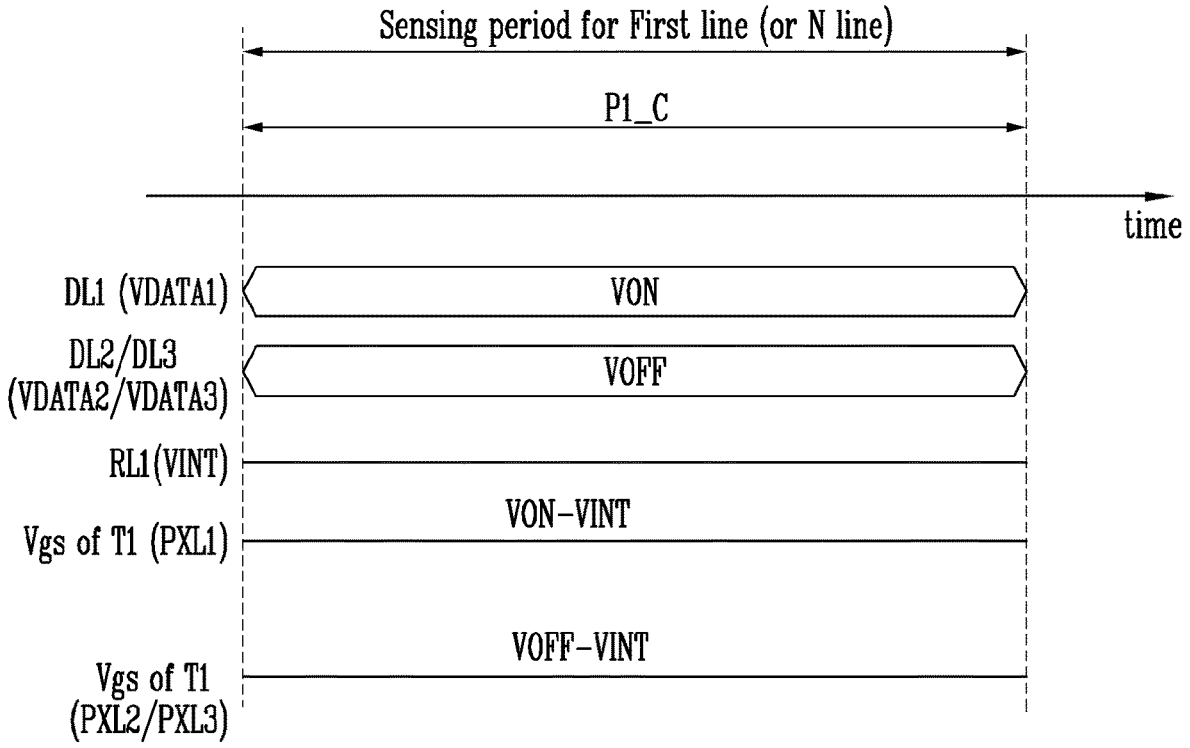
FIG. 8 is a schematic timing diagram illustrating a comparative embodiment of signals measured by the display unit of FIG. 5A.
Figure 9:
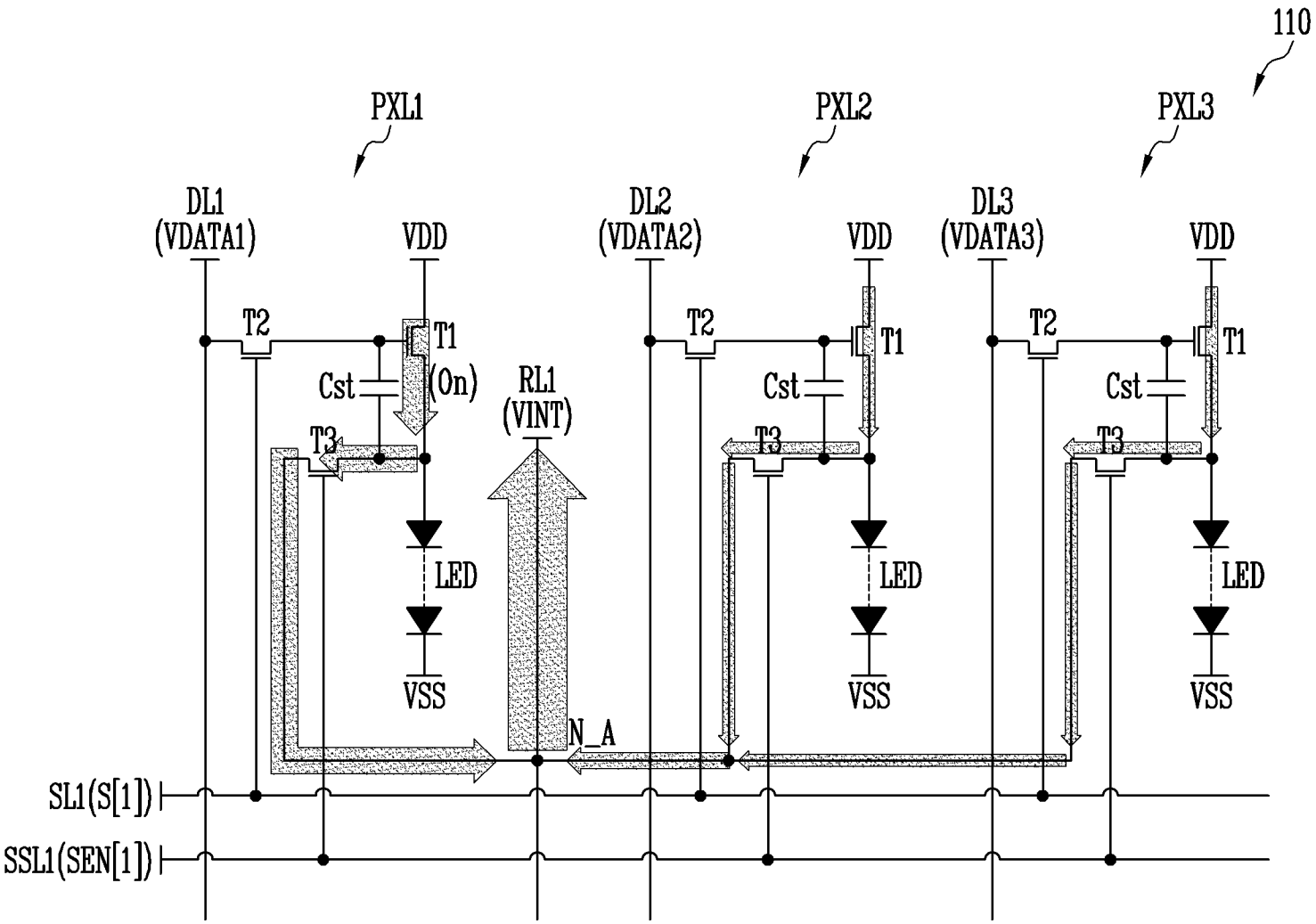
FIG. 9 is a schematic diagram of an equivalent circuit of the display unit of FIG. 5A illustrating an operation of the display unit according to signals of FIG. 8.

FIG. 8 is a schematic timing diagram illustrating a comparative embodiment of signals measured by the display unit of FIG. 5A. FIG. 9 is a schematic diagram of an equivalent circuit of the display unit of FIG. 5A illustrating an operation of the display unit according to signals of FIG. 8.

Referring to FIGS. 8 and 9, the sensing period according to the comparative embodiment may include only a first period P1_C. Since each operation of the first, second, and third pixels PXL1, PXL2, and PXL3 in the first period P1_C is similar to each operation of the first, second, and third pixels PXL1, PXL2, and PXL3 in the first period P1 of FIG. 6, repetitive descriptions thereof will be omitted.

The first data signal VDATA1 (or the test signal) applied to the first data line DL1 in the first period P1_C may have the turn-on voltage VON (or the turn-on voltage level). In this case, in the first period P1_C, the gate-source voltage Vgs of the first transistor T1 of the first pixel PXL1 may be equal to the difference between the turn-on voltage VON and the third power voltage VINT (e.g., Vgs is VON-VINT). As shown in FIG. 9, a sensing signal corresponding to the gate-source voltage Vgs of the first transistor T1 may be output from the first pixel PXL1 through the first readout line RL1.

Referring back to FIG. 8, the second and third data signals VDATA2 and VDATA3 applied to the second and third data lines DL2 and DL3 (or the remaining data lines) in the first period P1_C may have the turn-off voltage VOFF (or the turn-off voltage level). In this case, in the first period P1_C, the gate-source voltage Vgs of the first transistor T1 of each of the second and third pixels PXL2 and PXL3 may be equal to the difference between the turn-off voltage VOFF and the third power voltage VINT (e.g., Vgs is VOFF-VINT).

As described above, since the reliability of the first transistor T1 may decrease in case that the gate-source voltage Vgs has a negative value (or in case that the negative voltage is applied for a long time), the turn-off voltage VOFF may be set so that the gate-source voltage Vgs is greater than zero. For example, the turn-off voltage VOFF may be greater than the third power voltage VINT.

In case that the threshold voltage Vth of at least one of the first transistors T1 of the second and third pixels PXL2 and PXL3 is less than zero (or shifted in the negative direction), the first transistor T1 may not be completely turned off, and a leakage current may be generated from at least one of the second and third pixels PXL2 and PXL3. As shown in FIG. 9, the leakage current may be output from the second and third pixels PXL2 and PXL3 to the first readout line RL1. Accordingly, since the leakage current from the second and third pixels PXL2 and PXL3 are added to the sensing signal from the first pixel PXL1, the electrical characteristic of the first pixel PXL1 may not be accurately sensed.

Since the turn-off voltage VOFF is set to be greater than the third power voltage VINT, the sensing period according to the comparative embodiment may not include the second period P2 (refer to FIG. 6) for resetting the first transistor T1.

Figure 10:
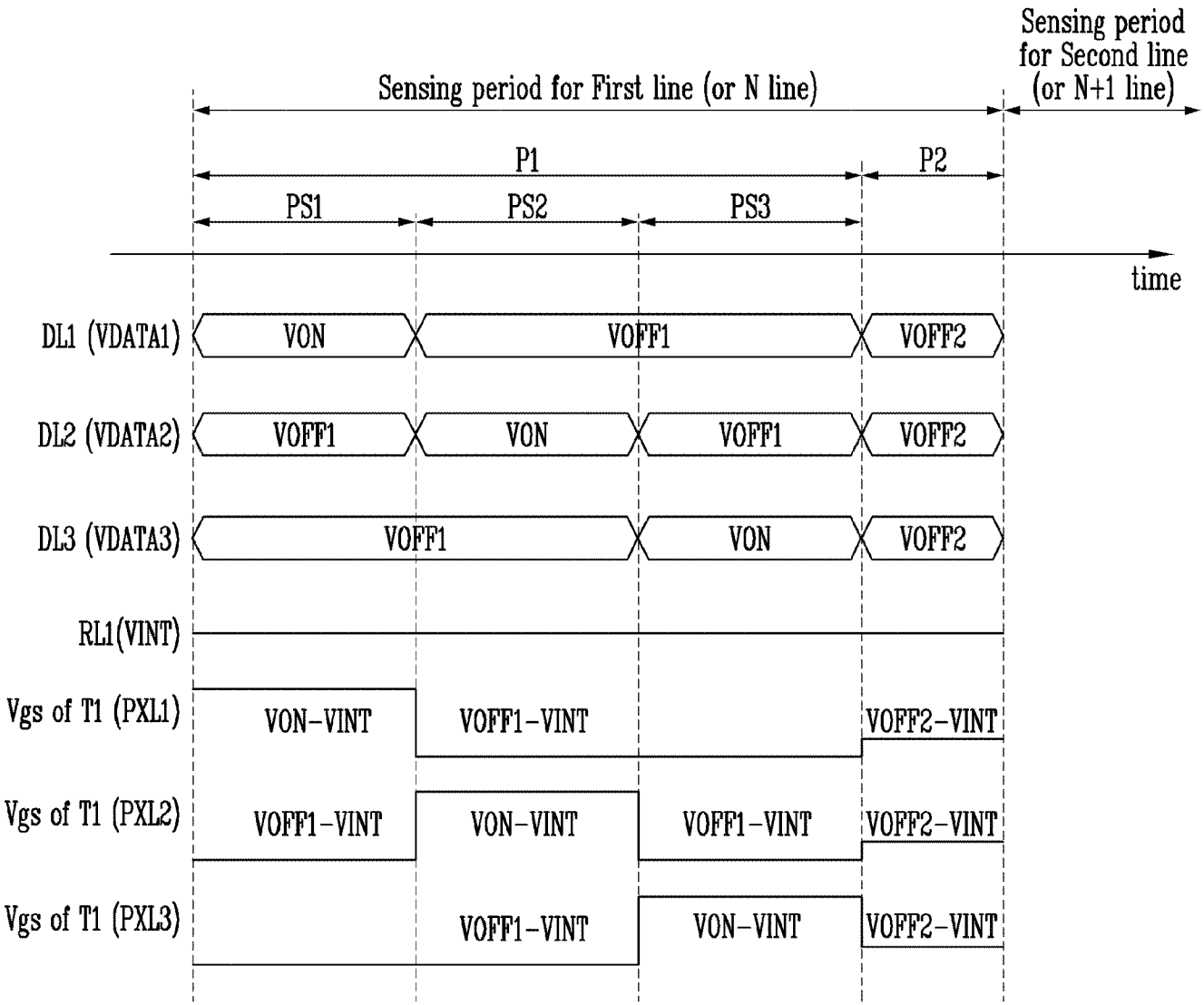
FIG. 10 is a schematic timing diagram illustrating another embodiment of signals measured by the display unit of FIGS. 5A to 5D.

FIG. 10 is a schematic timing diagram illustrating another embodiment of signals measured by the display unit of FIGS. 5A to 5D.

Referring to FIGS. 5A to 5D and 10, the sensing period (e.g., the sensing period for the first line or the first pixel row) may include the first period P1 (or the individual sensing period) and the second period P2 (or the reset period). The sensing period for each of the second, N-th, and N+1-th lines may also include the first period P1 and the second period P2 (here N is an integer greater than 1).

In at least portions of the first period P1 and the second period P2, the first scan signal S[1] and the first sensing scan signal SEN[1] may have turn-on voltage levels (e.g., a logic high level), and the second and third transistors T2 and T3 of each of the first, second, and third pixels PXL1, PXL2, and PXL3 may be turned on. In the first period P1 and the second period P2, the third power voltage VINT may be applied to the first readout line RL1, and the third power voltage VINT may be applied to the second electrode (or the source electrode, the second node N2 (refer to FIG. 2)) of the first transistor T1 of each of the first, second, and third pixels PXL1, PXL2, and PXL3 by the turned-on third transistor T3.

In embodiments, the first period P1 may include first, second, and third sub-periods PS1, PS2, and PS3. The electrical characteristic of the first pixel PXL1 may be sensed in the first sub-period PS1, the electrical characteristic of the second pixel PXL2 may be sensed in the second sub-period PS2, and the electrical characteristic of the third pixel PXL3 may be sensed in the third sub-period PS3. On the other hand, in case that other pixels sharing the first readout line RL1 (refer to FIGS. 5A to 5D) further exist, the first period P1 may further include a sub-period for sensing the electrical characteristic of the other pixels.

Since the operation of the first, second, and third pixels PXL1, PXL2, and PXL3 in the first sub-period PS1 are substantially the same as or similar to the operation of the first pixels PXL1, second pixels PXL2, and third pixels PXL3 in the first period P1 of FIG. 6, a description of the first sub-period PS1 will be omitted.

The second data signal VDATA2 (or the test signal) applied to the second data line DL2 in the second sub-period PS2 may have the turn-on voltage VON (or the turn-on voltage level). The turn-on voltage VON may be applied to the gate electrode of the first transistor T1 of the second pixel PXL2 by the turned-on second transistor T2. In this case, in the second sub-period PS2, the gate-source voltage Vgs of the first transistor T1 of the second pixel PXL2 may be equal to the difference between the turn-on voltage VON and the third power voltage VINT (e.g., Vgs is VON-VINT). The sensing signal corresponding to the gate-source voltage Vgs of the first transistor T1 may be output from the second pixel PXL2 through the first readout line RL1.

In the second sub-period PS2, the first and third data signals VDATA1 and VDATA3 applied to the first and third data lines DL1 and DL3 (or the remaining data lines) may have the first turn-off voltage VOFF1 (or the first turn-off voltage level). The first turn-off voltage VOFF1 may be applied to the gate electrode of the first transistor T1 of each of the first and third pixels PXL1 and PXL3 by the turned-on second transistor T2. In this case, the gate-source voltage Vgs of the first transistor T1 of each of the first and third pixels PXL1 and PXL3 in the second sub-period PS2 may be equal to the difference between the first turn-off voltage VOFF1 and the third power voltages VINT (e.g., Vgs is VOFF1−VINT). The first transistor T1 of each of the first and third pixels PXL1 and PXL3 may be completely turned off by the first turn-off voltage VOFF1, and the leakage current may not be generated from the first and third pixels PXL1 and PXL3 to the first readout line RL1. Accordingly, only the electrical characteristic of the second pixel PXL2 may be accurately sensed in the second sub-period PS2.

The third data signal VDATA3 applied to the third data line DL3 in the third sub-period PS3 may have the turn-on voltage VON, and the turn-on voltage VON may be applied to the gate electrode of the first transistor T1 of the third pixel PXL3 by the second transistor T2 turned on. In this case, in the third sub-period PS3, the gate-source voltage Vgs of the first transistor T1 of the third pixel PXL3 may be equal to the difference between the turn-on voltage VON and the third power voltage VINT (e.g., Vgs is VON-VINT). The sensing signal corresponding to the gate-source voltage Vgs of the first transistor T1 may be output from the third pixel PXL3 through the first readout line RL1.

In the third sub-period PS3, the first and second data signals VDATA1 and VDATA2 applied to the first and second data lines DL1 and DL2 (or the remaining data lines) may have the first turn-off voltage VOFF1. The first turn-off voltage VOFF1 may be applied to the gate electrode of the first transistor T1 of the first and second pixels PXL1 and PXL2 by the turned-on second transistor T2. In this case, in the third sub-period PS3, the gate-source voltage Vgs of the first transistor T1 of each of the first and second pixels PXL1 and PXL2 may be equal to the difference between the first turn-off voltage VOFF1 and the third power voltages VINT (e.g., Vgs is VOFF1−VINT). The first transistor T1 of each of the first and second pixels PXL1 and PXL2 may be completely turned off by the first turn-off voltage VOFF1, and the leakage current may not be generated from the first and second pixels PXL1 and PXL2 to the first readout line RL1. Accordingly, only the electrical characteristic of the third pixel PXL3 may be accurately sensed in the third sub-period PS3.

In the second period P2, the first, second, and third data signals VDATA1, VDATA2, and VDATA3 applied to the first, second, and third data lines DL1, DL2, and DL3 may have the second turn-off voltage VOFF2 (or the second turn-off voltage level). In this case, the gate-source voltage Vgs of the first transistor T1 of each of the first, second, and third pixels PXL1, PXL2, and PXL3 may be equal to the difference between the second turn-off voltage VOFF2 and the third power voltage VINT (e.g., Vgs is VOFF2−VINT). Since the first transistor T1 of each of the first, second, and third pixels PXL1, PXL2, and PXL3 is reset (or initialized) by the second turn-off voltage VOFF2 in the second period P2, the first turn-off voltage VOFF1 can be prevented from being applied or maintained for a long time, and the deterioration of the reliability of the first transistor T1 can be prevented due to an application of the first turn-off voltage VOFF1 for a long-time.

As described above, the display device 100 (refer to FIG. 1) may sequentially sense the electrical characteristic of the first, second, and third pixels PXL1, PXL2, and PXL3 in the first period P1, and may provide the first turn-off voltage VOFF1 to the remaining pixels that are not sensing targets. Accordingly, the leakage current from the remaining pixels can be completely blocked, and only the electrical characteristic of the pixel that is a sensing target can be accurately sensed. Thereafter, the display device 100 may provide the second turn-off voltage VOFF2 to the first, second, and third pixels PXL1, PXL2, and PXL3 in the second period P2.

Accordingly, the deterioration of the reliability of the first transistor T1 of each of the first, second, and third pixels PXL1, PXL2, and PXL3 due to the application of the first turn-off voltage VOFF1 for a long-time may be prevented.

Figure 11:
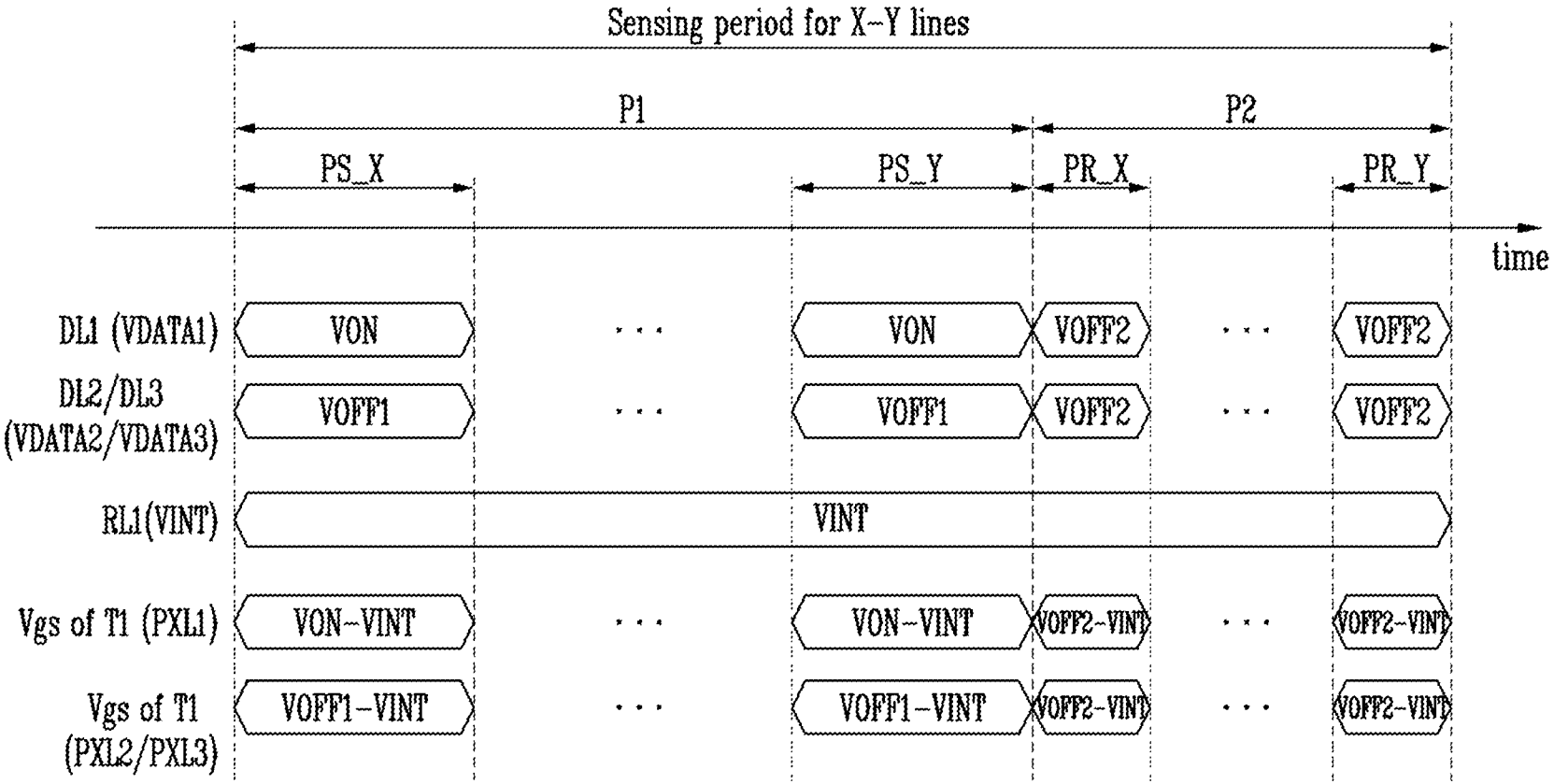
FIG. 11 is a schematic timing diagram illustrating another embodiment of signals measured by the display unit of FIGS. 5A to 5D.

FIG. 11 is a schematic timing diagram illustrating another embodiment of signals measured by the display unit of FIGS. 5A to 5D.

Referring to FIGS. 5A to 5D and 11, the sensing period may include the first period P1 (or the individual sensing period) and the second period P2 (or the reset period). In the first period P1, the electrical characteristic of the pixels included in lines (or pixel rows) may be sensed. For example, the electrical characteristic of pixels included in the X-th to Y-th lines may be sensed in the first period P1 (here X is an integer greater than 1 and Y is an integer greater than X).

In the first period P1 and the second period P2, the third power voltage VINT may be applied to the first readout line RL1.

In embodiments, the first period P1 may include an X-th line sensing period PS_X and a Y-th line sensing period PS_Y. For example, in the X-th line sensing period PS_X, the electrical characteristic of the first pixel PXL1 of the X-th line can be sensed, and in the Y-th line sensing period PS_Y, the electrical characteristic of the first pixel PXL1 of the Y-th line can be sensed.

In the X-th line sensing period PS_X, only an X-th scan signal and an X-th sensing scan signal may have a turn-on voltage level (e.g., a logic high level).

In the X-th line sensing period PS_X, the first data signal VDATA1 (or the test signal) applied to the first data line DL1 may have the turn-on voltage VON (or the turn-on voltage level). In this case, the turn-on voltage VON may be applied to the gate electrode of the first transistor T1 of the first pixel PXL1 on the X-th line, and the gate-source voltage Vgs of the first transistor T1 of the first pixel PXL1 on the X-th line may be equal to the difference between the turn-on voltage VON and the third power voltage VINT (e.g., Vgs is VON-VINT). The sensing signal corresponding to the gate-source voltage Vgs of the first transistor T1 may be output from the first pixel PXL1 on the X-th line through the first readout line RL1.

In the X-th line sensing period PS_X, the second and third data signals VDATA2 and VDATA3 applied to the second and third data lines DL2 and DL3 (or the remaining data lines) may have the first turn-off voltage VOFF1 (or the first turn-off voltage level). The first turn-off voltage VOFF1 may be applied to the gate electrode of the first transistor T1 of each of the second and third pixels PXL2 and PXL3 on the X-th line. In this case, in the X-th line sensing period PS_X, the gate-source voltage Vgs of the first transistor T1 of each of the second and third pixels PXL2 and PXL3 may be equal to the difference between the first turn-off voltage VOFF1 and the third power voltage VINT (e.g., Vgs is VOFF1−VINT). The first transistor T1 of each of the second and third pixels PXL2 and PXL3 may be completely turned off by the first turn-off voltage VOFF1, and the leakage current may not be generated from the second and third pixels PXL2 and PXL3 to the first readout line RL1. Accordingly, only the electrical characteristic of the first pixel PXL1 on the X-th line may be accurately sensed in the X-th line sensing period PS_X.

In the Y-th line sensing period PS_Y, only the Y-th scan signal and the Y-th sensing scan signal may have a turn-on voltage level.

The first data signal VDATA1 applied to the first data line DL1 in the Y-th line sensing period PS_Y may have a turn-on voltage VON. In this case, the turn-on voltage VON may be applied to the gate electrode of the first transistor T1 of the first pixel PXL1 on the Y-th line, and the gate-source voltage Vgs of the first transistor T1 of the first pixel PXL1 on the Y-th line may be equal to the difference between the turn-on voltage VON and the third power voltage VINT (e.g., Vgs is VON-VINT). The sensing signal corresponding to the gate-source voltage Vgs of the first transistor T1 may be output from the first pixel PXL1 of the Y-th line through the first readout line RL1.

In the Y-th line sensing period PS_Y, the second and third data signals VDATA2 and VDATA3 applied to the second and third data lines DL2 and DL3 (or the remaining data lines) may have the first turn-off voltage VOFF1 (or the first turn-off voltage level). The first turn-off voltage VOFF1 may be applied to the gate electrode of the first transistor T1 of each of the second and third pixels PXL2 and PXL3 on the Y-th line. In this case, in the Y-th line sensing period PS_Y, the gate-source voltage Vgs of the first transistor T1 of each of the second and third pixels PXL2 and PXL3 may be equal to the difference between the first turn-off voltage VOFF1 and the third power voltage VINT (e.g., Vgs is VOFF1−VINT). The first transistor T1 of each of the second and third pixels PXL2 and PXL3 may be completely turned off by the first turn-off voltage VOFF1, and the leakage current may not be generated from the second and third pixels PXL2 and PXL3 to the first readout line RL1. Accordingly, only the electrical characteristic of the first pixel PXL1 on the Y-th line may be accurately sensed in the Y-th line sensing period PS_Y.

In the second period P2, the first, second, and third data signals VDATA1, VDATA2, and VDATA3 applied to the first, second, and third data lines DL1, DL2, and DL3 may have the second turn-off voltage VOFF2 (or the second turn-off voltage level).

In at least a portion of the second period P2, the X-th scan signal, the X-th sensing scan signal, the Y-th scan signal, and the Y-th sensing scan signal may have turn-on voltage levels. In this case, the first transistor T1 of each of the first, second, and third pixels PXL1, PXL2, and PXL3 on the X-th line and the first, second, and third pixels PXL1, PXL2, and PXL3 on the Y-th line, may be reset (or initialized) by the second turn-off voltage VOFF2.

In an embodiment, the second period P2 may include an X-th line reset period PR_X and a Y-th line reset period PR_Y. For example, in the X-th line reset period PR_X, the X-th scan signal and the X-th sensing scan signal may have turn-on voltage levels, and the first, second, and third pixels PXL1, PXL2, and PXL3 on the X-th line may be reset. For example, in the Y-th line reset period PR_Y, the Y-th scan signal and the Y-th sensing scan signal may have turn-on voltage levels, and the first, second, and third pixels PXL1, PXL2, and PXL3 on the Y-th line may be reset.

As described above, the display device 100 (refer to FIG. 1) may sequentially sense the electrical characteristic of the pixels included in lines (e.g., the X-th line and the Y-th line) for each line in the first period P1. The display device 100 may simultaneously or sequentially reset the pixels included in the lines by using the second turn-off voltage VOFF2 in the second period P2. For example, the reset of the pixel using the second turn-off voltage VOFF2 may be performed for each pixel (refer to FIG. 6), may be performed line-by-line (refer to FIG. 10), or may be performed in units of lines (refer to FIG. 11).

It has been described that only the electrical characteristic of the first pixel PXL1 is sensed with reference to FIG. 11, but the disclosure is not limited thereto. By applying the embodiment of FIG. 10 to the X-th line sensing period PS_X and the Y-th line sensing period PS_Y, the electrical characteristics of other pixels (e.g., the second pixel PXL2 and the third pixel PXL3) in the corresponding line can also be sensed.

Figure 12:
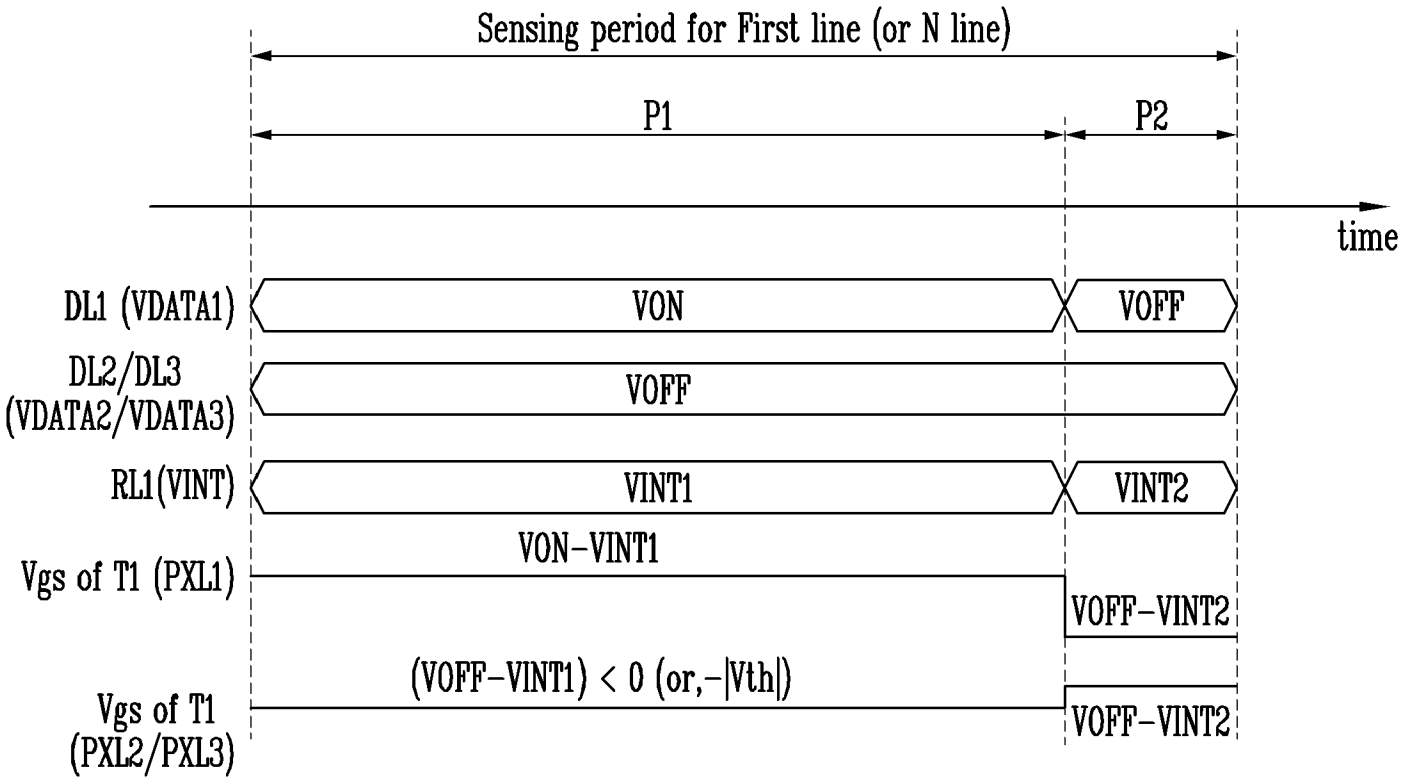
FIG. 12 is a schematic timing diagram illustrating another embodiment of signals measured by the display unit of FIGS. 5A to 5D.

FIG. 12 is a schematic timing diagram illustrating another embodiment of signals measured by the display unit of FIGS. 5A to 5D. FIG. 12 illustrates, as an example, a method of sensing the electrical characteristic of the first pixel PXL1 included in the display unit 110 of FIGS. 5A to 5D.

Referring to FIGS. 5A to 5D, 6, 7, and 12, the sensing period (e.g., the sensing period for the first line or the first pixel row) may include the first period P1 (or the individual sensing period) and the second period P2 (or the reset period).

In at least portions of the first period P1 and the second period P2, the first scan signal S[1] and the first sensing scan signal SEN[1] may have turn-on voltage levels (e.g., a logic high level), and the second and third transistors T2 and T3 of each of the first, second, and third pixels PXL1, PXL2, and PXL3 may be turned on.

The third power voltage VINT applied to the first readout line RL1 in the first period P1 may have a first initialization voltage VINT1. The first initialization voltage VINT1 may be applied to the second electrode (or the source electrode, the second node N2 (refer to FIG. 2)) of the first transistor T1 of each of the first, second, and third pixels PXL1, PXL2, and PXL3 by the turned-on third transistor T3.

The first data signal VDATA1 (or the test signal) applied to the first data line DL1 in the first period P1 may have the turn-on voltage VON (or the turn-on voltage level). The turn-on voltage VON may be applied to the gate electrode of the first transistor T1 of the first pixel PXL1 by the turned-on second transistor T2.

In this case, in the first period P1, the gate-source voltage Vgs of the first transistor T1 of the first pixel PXL1 may be equal to the difference between the turn-on voltage VON and the first initialization voltage VINT1 (e.g., Vgs is VON-VINT1). The sensing signal corresponding to the gate-source voltage Vgs of the first transistor T1 may be output from the first pixel PXL1 through the first readout line RL1 (refer to FIG. 7).

In the first period P1, the second and third data signals VDATA2 and VDATA3 applied to the second and third data lines DL2 and DL3 (or the remaining data lines) may have the turn-off voltage VOFF (or the turn-off voltage level). The turn-off voltage VOFF may be applied to the gate electrode of the first transistor T1 of the second and third pixels PXL2 and PXL3 by the turned-on second transistor T2.

In this case, in the first period P1, the gate-source voltage Vgs of the first transistor T1 of each of the second and third pixels PXL2 and PXL3 may be equal to the difference between the turn-off voltage VOFF and the first initialization voltage VINT1 (e.g., Vgs is VOFF-VINT1).

In embodiments, the first initialization voltage VINT1 may have a voltage level that makes the gate-source voltage Vgs less than zero or a negative threshold voltage −|Vth| (or a negative value with a magnitude of the threshold voltage Vth) of the first transistor T1. In other words, the difference between the turn-off voltage VOFF and the first initialization voltage VINT1 may be less than zero or a negative threshold voltage −|Vth| (e.g., VOFF−VINT1<0, or VOFF−VINT1<−|Vth|). For example, the first initialization voltage VINT1 may be greater than the turn-off voltage VOFF or may be greater than the turn-off voltage VOFF by the magnitude of the threshold voltage Vth. For example, in case that the turn-off voltage VOFF is about 2V and a maximum value of the threshold voltage Vth is about 1V, the first initialization voltage VINT1 may be about 3V.

In this case, even if the threshold voltage Vth of the first transistor T1 of at least one of the second and third pixels PXL2 and PXL3 has a negative value, the first transistor T1 may be completely turned off by the first initialization voltage VINT1. Therefore, no leakage current is generated from the second and third pixels PXL2 and PXL3 to the first readout line RL1 (refer to FIG. 7), and in the first period P1, only the electrical characteristic of the first pixel PXL1 may be accurately sensed.

The third power voltage VINT applied to the first readout line RL1 in the second period P2 may have a second initialization voltage VINT2. The second initialization voltage VINT2 may be applied to the second electrode (or the source electrode, the second node N2 (refer to FIG. 2)) of the first transistor T1 of each of the first, second, and third pixels PXL1, PXL2, and PXL3 by the turned-on third transistor T3.

In the second period P2, the first, second, and third data signals VDATA1, VDATA2, and VDATA3 applied to the first, second, and third data lines DL1, DL2, and DL3 may have the turn-off voltage VOFF. The turn-off voltage VOFF may be applied to the gate electrode of the first transistor T1 of each of the first, second, and third pixels PXL1, PXL2, and PXL3 by the turned-on second transistor T2.

In this case, the gate-source voltage Vgs of the first transistor T1 of each of the first, second, and third pixels PXL1, PXL2, and PXL3 in the second period P2 may be equal to the difference between the turn-off voltage VOFF and the second initialization voltage VINT2 (e.g., Vgs is VOFF-VINT2).

In embodiments, the second initialization voltage VINT2 may have a voltage level that makes the gate-source voltage Vgs greater than or equal to zero. In other words, the difference between the turn-off voltage VOFF and the second initialization voltage VINT2 may be greater than or equal to zero (e.g., VOFF−VINT2>0), and the second initialization voltage VINT2 may be less than or equal to the turn-off voltage VOFF. For example, the second initialization voltage VINT2 may be about 2V. The difference between the turn-off voltage VOFF and the second initialization voltage VINT2 may be less than an absolute value |Vth| of the threshold voltage of the first transistor T1, but the disclosure is not limited thereto.

In this case, since the first transistor T1 of each of the second and third pixels PXL2 and PXL3 is reset (or initialized) by the second initialization voltage VINT2 in the second period P2, it is possible to prevent the gate-source voltage from having a negative value for a long time, and to prevent the deterioration of the reliability of the first transistor T1 due to the application of the first initialization voltage VINT1 thereto for a long time.

In the embodiment of FIG. 6, the gate-source voltage of the first transistor T1 may be controlled by using the data signal (e.g., the first turn-off voltage VOFF1 and the second turn-off voltage VOFF2) applied to the gate electrode of the first transistor T1, and in the embodiment of FIG. 12, the gate-source voltage of the first transistor T1 may be controlled by using the third power voltage VINT (e.g., the first initialization voltage VINT1 and the second initialization voltage VINT2) applied to the source electrode of the first transistor T1.

As described above, in sensing the electrical characteristic of the first pixel PXL1 in the sensing period, the display device 100 (refer to FIG. 1) may provide the first initialization voltage VINT1 to the second and third pixels PXL2 and PXL3 (e.g., the remaining pixels PXL sharing the first readout line RL1 with the first pixel PXL1) through the first readout line RL1 in the first period P1. Accordingly, the leakage current from the second and third pixels PXL2 and PXL3 can be completely blocked, and only the electrical characteristic of the first pixel PXL1 may be accurately sensed. The display device 100 may provide the second initialization voltage VINT2 to the second and third pixels PXL2 and PXL3 through the first readout line RL1 in the second period P2. Accordingly, the deterioration of the reliability of the first transistor T1 of each of the second and third pixels PXL2 and PXL3 due to the application of the first initialization voltage VINT1 for a long time may be prevented.

It has been described that only the electrical characteristic of the first pixel PXL1 are sensed with reference to FIG. 12, but the disclosure is not limited thereto. For example, as described with reference to FIG. 6, by sequentially applying the embodiment of FIG. 12 to the second pixel PXL2 and the third pixel PXL3, the electrical characteristics of the first, second, and third pixels PXL1, PXL2, and PXL3 may be sequentially sensed. For another example, as described with reference to FIG. 10, the electrical characteristics of the first, second, and third pixels PXL1, PXL2, and PXL3 may be sequentially sensed, and after sensing the characteristics, the first, second, and the third pixels PXL1, PXL2, and PXL3 may be reset.

Figure 13:
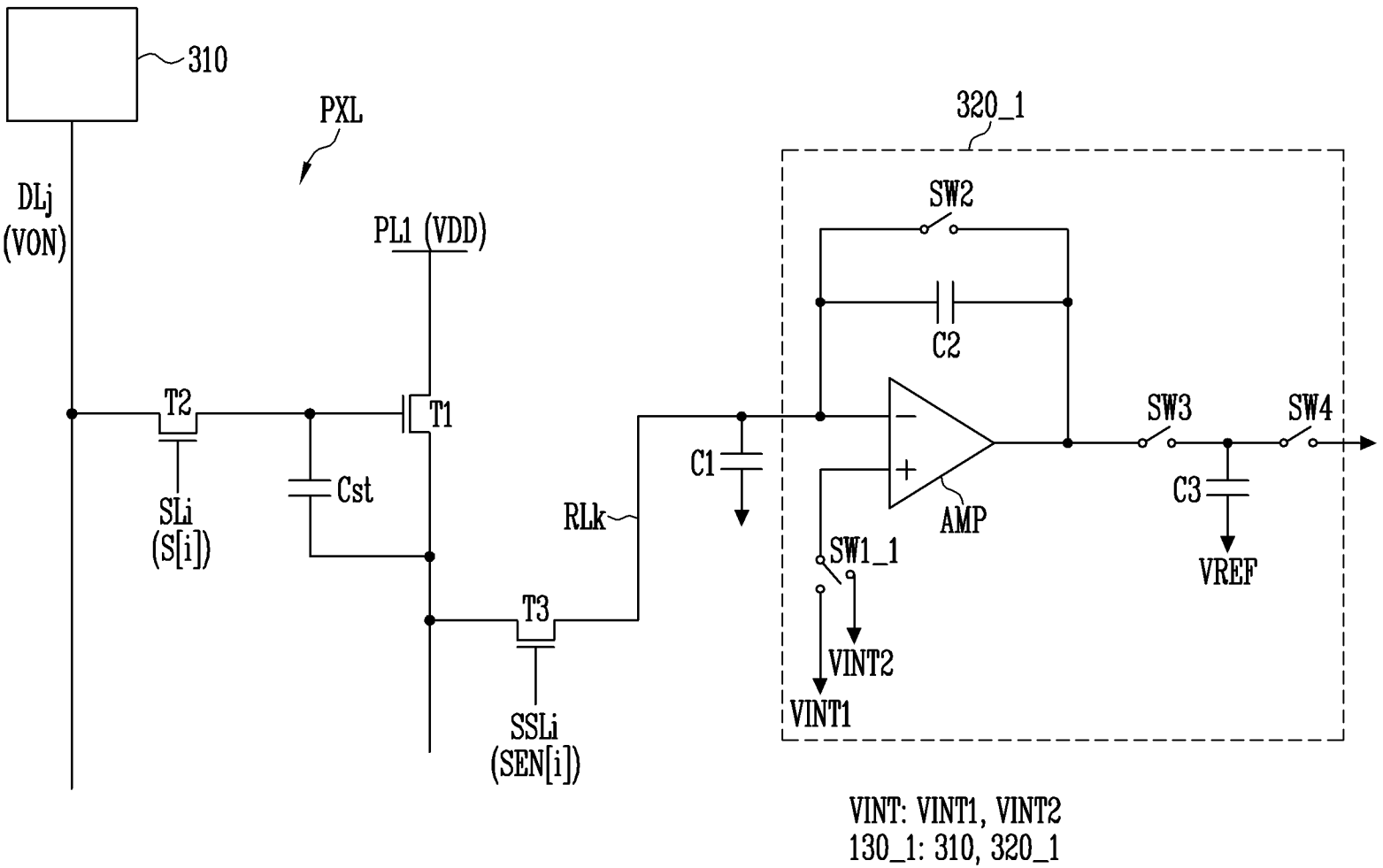
FIG. 13 is a schematic diagram of an equivalent circuit of another embodiment of a sensing circuit included in the data driver of FIG. 1.

FIG. 13 is a schematic diagram of an equivalent circuit of another embodiment of a sensing circuit included in the data driver of FIG. 1.

Referring to FIGS. 1 to 3, 12, and 13, a data driver 130_1 (or the sensing circuit 320_1) of FIG. 13 may be substantially the same as or similar to the data driver 130 (or a sensing circuit 320) of FIG. 3 except for a first switch SW1_1. Therefore, repetitive descriptions thereof will be omitted.

The first switch SW1_1 may electrically connect a second input terminal of the amplifier AMP to the first initialization voltage VINT1 (or the first initialization power) or the second initialization voltage VINT2 (or the second initialization power). As described with reference to FIG. 12, the first initialization voltage VINT1 and the second initialization voltage VINT2 may have different voltage levels. For example, the first initialization voltage VINT1 may have a higher voltage level than the second initialization voltage VINT2. The first initialization voltage VINT1 and the second initialization voltage VINT2 may be included in the third power voltage VINT and may be provided from the power supply 150. In other words, the power supply 150 may provide the first initialization voltage VINT1 and the second initialization voltage VINT2 to the data driver 130_1 (or the sensing circuit 320_1).

The first switch SW1_1 may electrically connect the second input terminal of the amplifier AMP to the first initialization voltage VINT1 in the first period P1 of the sensing period (refer to FIG. 12). In this case, the first initialization voltage VINT1 may be applied to the pixel PXL through the first switch SW1_1, the amplifier AMP, the k-th readout line RLk, and the third transistor T3. The first switch SW1_1 may electrically connect the second input terminal of the amplifier AMP to the second initialization voltage VINT2 in the second period P2 of the sensing period (refer to FIG. 12). In this case, the second initialization voltage VINT2 may be applied to the pixel PXL through the first switch SW1_1, the amplifier AMP, the k-th readout line RLk, and the third transistor T3.

As described above, by controlling the operation of the first switch SW1_1 in the data driver 130_1 (or the sensing circuit 320_1), the third power voltage VINT provided to the display unit 110 may be changed in first period P1 and the second period P2.

Figure 14:
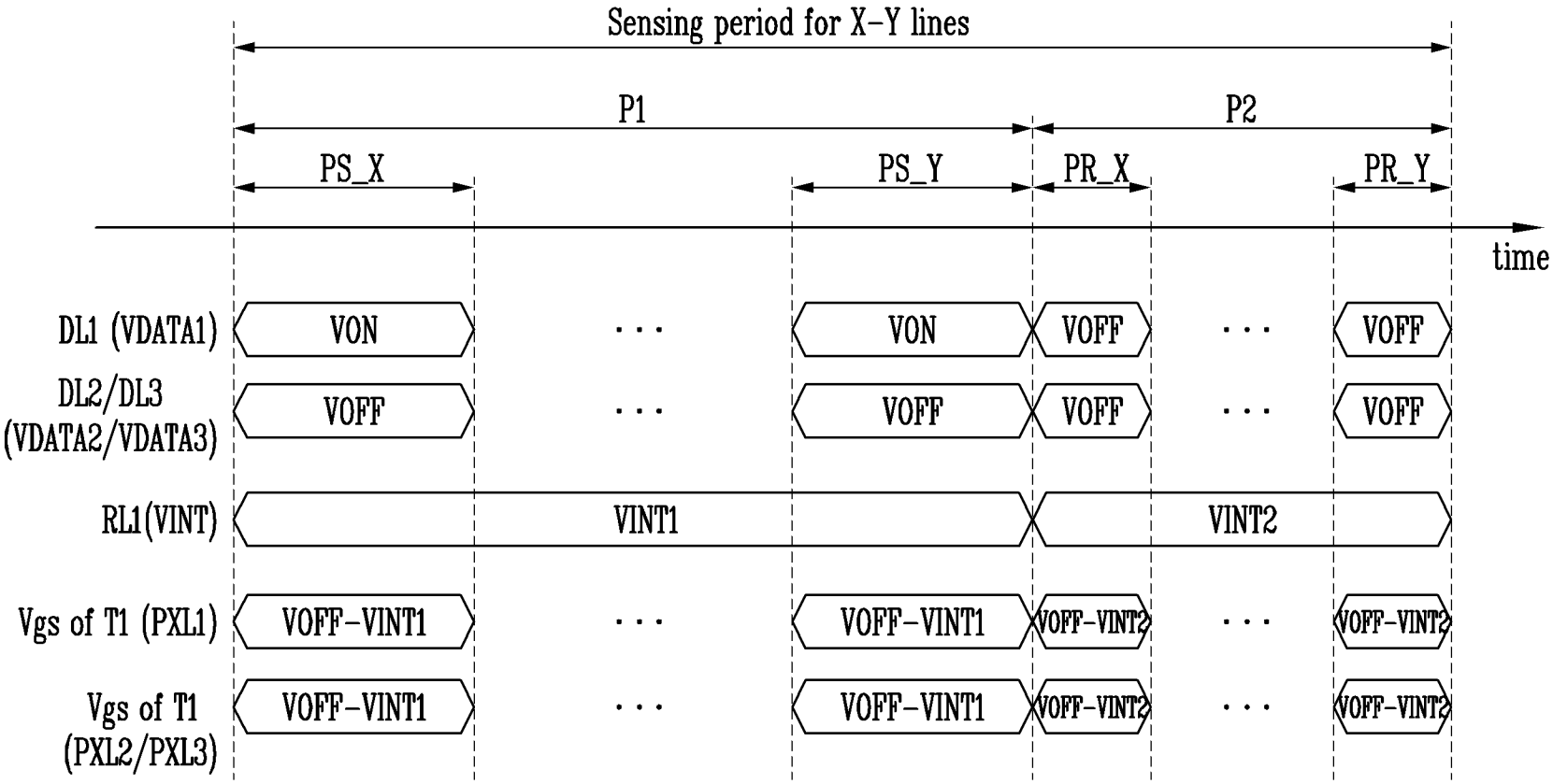
FIG. 14 is a schematic timing diagram illustrating another embodiment of signals measured by the display unit of FIGS. 5A to 5D.

FIG. 14 is a schematic timing diagram illustrating another embodiment of signals measured by the display unit of FIGS. 5A to 5D.

Referring to FIGS. 5A to 5D and 14, the sensing period may include the first period P1 (or the individual sensing period) and the second period P2 (or the reset period). The first period P1 may include the X-th line sensing period PS_X and the Y-th line sensing period PS_Y. The second period P2 may include the X-th line reset period PR_X and the Y-th line reset period PR_Y. The first period P1, the X-th line sensing period PS_X, the Y-th line sensing period PS_Y, the second period P2, the X-th line reset period PR_X, the Y-th line reset period PR_Y, and the scan signal and the sensing scan signal applied to the periods have been described with reference to FIG. 11, and thus repetitive descriptions thereof will be omitted.

The third power voltage VINT may have the first initialization voltage VINT1 in the first period P1 and the second initialization voltage VINT2 in the second period P2. For example, the first initialization voltage VINT1 may be applied to the first readout line RL1 in the first period P1, and the second initialization voltage VINT2 may be applied to the first readout line RL1 in the second period P2.

The first data signal VDATA1 applied to the first data line DL1 in the X-th line sensing period PS_X may have the turn-on voltage VON. In this case, the turn-on voltage VON may be applied to the gate electrode of the first transistor T1 of the first pixel PXL1 on the X-th line, and the gate-source voltage Vgs of the first transistor T1 of the first pixel PXL1 on the X-th line may be equal to the difference between the turn-on voltage VON and the first initialization voltage VINT1 (e.g., Vgs is VON-VINT1). The sensing signal corresponding to the gate-source voltage Vgs of the first transistor T1 may be output from the first pixel PXL1 on the X-th line through the first readout line RL1.

In the X-th line sensing period PS_X, the second and third data signals VDATA2 and VDATA3 applied to the second and third data lines DL2 and DL3 (or the remaining data lines) may have the turn-off voltage VOFF. The turn-off voltage VOFF may be applied to the gate electrode of the first transistor T1 of each of the second and third pixels PXL2 and PXL3 on the X-th line. In this case, in the X-th line sensing period PS_X, the gate-source voltage Vgs of the first transistor T1 of each of the second and third pixels PXL2 and PXL3 may be equal to the difference between the turn-off voltage VOFF and the first initialization voltage VINT1 (e.g., Vgs is VOFF-VINT1). The first transistor T1 of each of the second and third pixels PXL2 and PXL3 may be completely turned off by the first initialization voltage VINT1, and the leakage current may not be generated from the second and third pixels PXL2 and PXL3 to the first readout line RL1. Accordingly, only the electrical characteristic of the first pixel PXL1 on the X-th line may be accurately sensed in the X-th line sensing period PS_X.

The first data signal VDATA1 applied to the first data line DL1 in the Y-th line sensing period PS_Y may have a turn-on voltage VON. In this case, the turn-on voltage VON may be applied to the gate electrode of the first transistor T1 of the first pixel PXL1 on the Y-th line, and the gate-source voltage Vgs of the first transistor T1 of the first pixel PXL1 on the Y-th line may be equal to the difference between the turn-on voltage VON and the first initialization voltage VINT1 (e.g., Vgs is VON-VINT1). The sensing signal corresponding to the gate-source voltage Vgs of the first transistor T1 may be output from the first pixel PXL1 of the Y-th line through the first readout line RL1.

In the Y-th line sensing period PS_Y, the second and third data signals VDATA2 and VDATA3 applied to the second and third data lines DL2 and DL3 (or the remaining data lines) may have turn-off voltage VOFF. The turn-off voltage VOFF may be applied to the gate electrode of the first transistor T1 of each of the second and third pixels PXL2 and PXL3 on the Y-th line. In this case, in the Y-th line sensing period PS_Y, the gate-source voltage Vgs of the first transistor T1 of each of the second and third pixels PXL2 and PXL3 may be equal to the difference between the turn-off voltage VOFF and the first initialization voltage VINT1 (e.g., Vgs is VOFF-VINT1). The first transistor T1 of each of the second and third pixels PXL2 and PXL3 may be completely turned off by the first initialization voltage VINT1, and the leakage current may not be generated from the second and third pixels PXL2 and PXL3 to the first readout line RL1. Accordingly, only the electrical characteristic of the first pixel PXL1 on the Y-th line may be accurately sensed in the Y-th line sensing period PS_Y.

In the second period P2, the first, second, and third data signals VDATA1, VDATA2, and VDATA3 applied to the first, second, and third data lines DL1, DL2, and DL3 may have the turn-off voltage VOFF.

In at least a portion of the second period P2, the X-th scan signal, the X-th sensing scan signal, the Y-th scan signal, and the Y-th sensing scan signal may have turn-on voltage levels. In this case, the first transistor T1 of each of the first, second, and third pixels PXL1, PXL2, and PXL3 on the X-th line and the first, second, and third pixels PXL1, PXL2, and PXL3 on the Y-th line, may be reset (or initialized) by the second initialization voltage VINT2 (and the turn-off voltage VOFF).

For example, in the X-th line reset period PR_X, the X-th scan signal and the X-th sensing scan signal may have turn-on voltage levels, and the first, second, and third pixels PXL1, PXL2, and PXL3 on the X-th line may be reset. For example, in the Y-th line reset period PR_Y, the Y-th scan signal and the Y-th sensing scan signal may have turn-on voltage levels, and the first, second, and third pixels PXL1, PXL2, and PXL3 on the Y-th line may be reset.

As described above, the display device 100 (refer to FIG. 1) may sequentially sense the electrical characteristic of the pixels included in lines (e.g., the X-th line and the Y-th line) for each line in the first period P1. The display device 100 may apply the first initialization voltage VINT1 to the readout line (e.g., the first readout line RL1) in the first period P1, so that it is possible to completely block the leakage current from the remaining pixels that are not sensing targets and to accurately sense only the electrical characteristic of the pixel that is a sensing target. The display device 100 may simultaneously or sequentially reset the pixels included in the lines by using the second initialization voltage VINT2 (and the turn-off voltage VOFF) in the second period P2.

Figure 15:
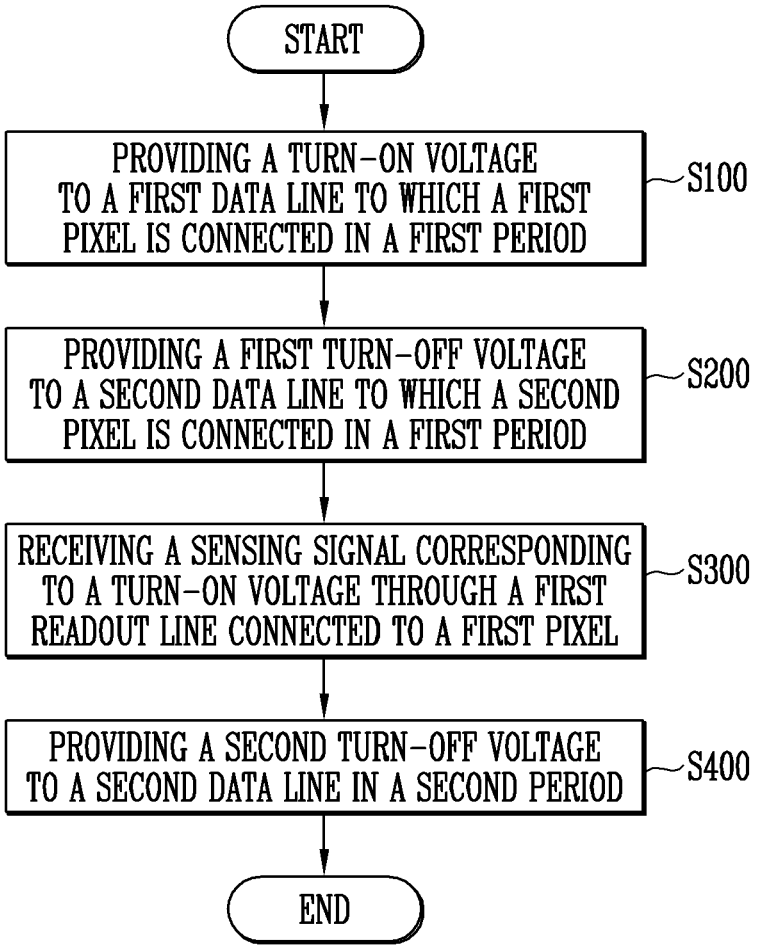
FIG. 15 is a schematic flowchart illustrating a driving method of a display device according to embodiments of the disclosure.

FIG. 15 is a schematic flowchart illustrating a driving method of a display device according to embodiments of the disclosure.

Referring to FIGS. 1, 5A to 5D, 6, 10, 11, and 15, the method of FIG. 15 may be performed in the display device 100 of FIG. 1.

The method of FIG. 15 may sense the electrical characteristic of the first pixel PXL1 in the sensing period. The sensing period may include the first period P1 and the second period P2. As described with reference to FIGS. 6, 10, and 11, the sensing period may be allocated for each pixel, each line, or lines.

In the method of FIG. 15, the turn-on voltage VON may be provided to the first data line DL1 to which the first pixel PXL1 is electrically connected, in the first period P1 (S100).

In the method of FIG. 15, the first turn-off voltage VOFF1 may be provided to the second data line DL2 to which the second pixel PXL2 is electrically connected, in the first period P1 (S200). As described with reference to FIG. 5A, the second pixel PXL2 may share the first scan line SL1, the first sensing scan line SSL1, and the first readout line RL1 with the first pixel PXL1.

As described with reference to FIGS. 6 and 7, the first turn-off voltage VOFF1 may be set to be lower than the third power voltage VINT (or the difference between the third power voltage VINT and the threshold voltage Vth of the first transistor T1). Accordingly, the gate-source voltage Vgs of the first transistor T1 in the second pixel PXL2 may be lower than zero (or the negative threshold voltage −|Vth|), the first transistor T1 in the second pixel PXL2 may be completely turned off, and the leakage current from the second pixel PXL2 to the first readout line RL1 may be completely blocked.

For example, in the method of FIG. 15, the gate-source voltage Vgs of the first transistor T1 in the second pixel PXL2 may be controlled to be lower than zero (or the negative threshold voltage −|Vth|) in the first period P1.

In the method of FIG. 15, a sensing signal corresponding to the turn-on voltage VON may be received from the first pixel PXL1 through the first readout line RL1 (S300). Since the leakage current from the second pixel PXL2 and the like to the first readout line RL1 is completely blocked, the electrical characteristic of the first pixel PXL1 may be accurately sensed.

Thereafter, in the method of FIG. 15, the second turn-off voltage VOFF2 may be provided to the second data line DL2 in the second period P2 (S400). As described with reference to FIGS. 6 and 7, the second turn-off voltage VOFF2 may be set to be higher than the third power voltage VINT. Accordingly, the gate-source voltage Vgs of the first transistor T1 in the second pixel PXL2 may be higher than zero, and the deterioration of the reliability of the first transistor T1 in the second pixel PXL2 can be prevented due to the application of the first turn-off voltage VOFF1 for a long time.

For example, in the method of FIG. 15, the gate-source voltage Vgs of the first transistor T1 in the second pixel PXL2 may be controlled to be higher than zero in the second period P2.

It has been described in FIG. 15 that the first turn-off voltage VOFF1 and the second turn-off voltage VOFF2, for example, the data signals, are controlled, but the disclosure is not limited thereto. As described with reference to FIG. 12, in the method of FIG. 15, the first initialization voltage VINT1 may be provided to the first readout line RL1 in the first period P1, and the second initialization voltage VINT2 may be provided to the first readout line RL1 in the second period P2.

The technical idea of the disclosure has been specifically described according to the embodiments, but it should be noted that the foregoing embodiments are provided only for illustration while not limiting the disclosure. In addition, it will be understood by those skilled in the art that various changes in form and details may be made therein without departing from the scope of the disclosure.

The technical scope of the disclosure may be determined by the technical scope of the accompanying claims. In addition, all changes or modifications that come within the meaning and range of the claims and their equivalents will be interpreted as including the range of the disclosure.

What is claimed is:

1. A display device comprising:

a display panel including:

scan lines;

a first data line;

a second data line;

a readout line; and pixels electrically connected to the scan lines, the first and second data lines, and the readout line;

a scan driver supplying a scan signal to the scan lines; and a data driver supplying data signals to the first and second data lines and supplying an initialization voltage to the readout line, wherein each of the pixels includes:

at least one light emitting element; and a driving transistor, the driving transistor controlling an amount of current flowing through the driving transistor based on a difference between a corresponding data signal among the data signals and the initialization voltage, in a sensing mode, the data driver supplies a test voltage to the first data line and a first off voltage to the second data line in a first period, and supplies a second off voltage to the second data line in a second period after the first period, and the first off voltage has a voltage level lower than the second off voltage.

2. The display device of claim 1, wherein the pixels include:

a first pixel electrically connected to the first data line; and a second pixel electrically connected to the second data line, and the data driver senses an electrical characteristic of the first pixel based on a sensing signal output from the readout line in response to the test voltage in the first period.

3. The display device of claim 2, wherein the driving transistor of the second pixel receiving the first off voltage or the second off voltage is substantially turned off.

4. The display device of claim 2, wherein the first period and the second period are included in a sensing period, and the sensing period is allocated for each scan line.

5. The display device of claim 2, wherein the first off voltage has a voltage level lower than the initialization voltage.

6. The display device of claim 3, wherein in the first period, a gate-source voltage of the driving transistor of the second pixel is lower than a negative threshold voltage of the driving transistor of the second pixel.

7. The display device of claim 2, wherein the second off voltage has a voltage level equal to or higher than the initialization voltage.

8. The display device of claim 2, wherein the readout line is commonly connected to the first pixel and the second pixel.

9. The display device of claim 2, wherein in a third period between the first period and the second period, the data driver supplies the first off voltage to the first data line and the test voltage to the second data line, and the data driver senses an electrical characteristic of the second pixel based on a sensing signal output from the readout line in response to the test voltage in the third period.

10. The display device of claim 2, wherein

The first pixel further includes:

a first switching transistor electrically connected between the first data line and a gate electrode of the driving transistor and including a gate electrode receiving the scan signal, and a second switching transistor electrically connected between the readout line and an electrode of the driving transistor and including a gate electrode for receiving the scan signal, and the electrode of the driving transistor is electrically connected to the at least one light emitting element.

11. The display device of claim 10, wherein the gate electrode of the first switching transistor is electrically connected to the gate electrode of the second switching transistor.

12. The display device of claim 2, wherein the at least one light emitting element includes a plurality of light emitting diodes electrically connected in series.

13. The display device of claim 1, wherein in the first period, the scan driver sequentially outputs the scan signal to the scan lines.

14. A display device comprising:

a display panel including:

scan lines;

a first data line;

a second data line;

a readout line; and pixels electrically connected to the scan lines, the first and second data lines, and the readout line;

a scan driver supplying a scan signal to the scan lines; and a data driver supplying data signals to the first and second data lines, wherein each of the pixels includes:

at least one light emitting element and a driving transistor; and the driving transistor controls an amount of current flowing through the driving transistor based on a corresponding data signal among the data signals, and in a sensing mode, the data driver supplies a test voltage to the first data line, an off voltage to the second data line, and a first initialization voltage to the readout line in a first period, and supplies a second initialization voltage to the readout line in a second period after the first period, and the initialization voltage has a voltage level higher than the second initialization voltage.

15. The display device of claim 14, wherein the pixels include:

a first pixel electrically connected to the first data line; and a second pixel electrically connected to the second data line, and the data driver senses an electrical characteristic of the first pixel based on a sensing signal output from the readout line in response to the test voltage in the first period.

16. The display device of claim 14, wherein the first initialization voltage has a voltage level higher than the off voltage.

17. The display device of claim 14, wherein the second initialization voltage has a voltage level equal to or lower than the off voltage.

18. The display device of claim 14, further includes:

a power supply supplying the first initialization voltage and the second initialization voltage to the data driver, wherein the data driver selects and supplies the first initialization voltage or the second initialization voltage to the readout line.

* * * * *